US005655602A

United States Patent [19]

Collins

[11] Patent Number: 5,655,602

[45] Date of Patent: Aug. 12, 1997

[54] APPARATUS AND PROCESS FOR DRILLING AND COMPLETING MULTIPLE WELLS

[75] Inventor: Gary J. Collins, Richmond, Tex.

[73] Assignee: Marathon Oil Company, Findlay, Ohio

[21] Appl. No.: 508,635

[22] Filed: Jul. 26, 1995

Related U.S. Application Data

[63] Continuation-in-part of Ser. No. 170,557, Dec. 20, 1993, Pat. No. 5,458,199, which is a continuation-in-part of Ser. No. 80,042, Jun. 18, 1993, Pat. No. 5,330,007, which is a continuation-in-part of Ser. No. 936,972, Aug. 28, 1992, abandoned.

[51] Int. Cl.[6] ..... E21B 15/04; E21B 43/01

[52] U.S. Cl. ..... 166/313; 166/366; 175/61

[58] Field of Search ..... 166/313, 97.5, 166/89.2, 242.3, 366, 368, 341, 342, 345; 175/5, 7–9, 61, 78, 79

[56] References Cited

U.S. PATENT DOCUMENTS

| | | | |
|---|---|---|---|
| 1,900,163 | 3/1933 | Dana et al. . | |
| 1,900,164 | 3/1933 | Dana et al. . | |
| 2,492,079 | 12/1949 | Wiley . | |
| 2,794,505 | 6/1957 | Allen | 166/86 |
| 3,011,552 | 12/1961 | Rhodes et al. | 166/67 |
| 3,052,301 | 9/1962 | Watts et al. | 166/97 |
| 3,080,922 | 3/1963 | Mater | 166/313 |
| 3,083,768 | 4/1963 | Althouse, Jr. et al. | 166/313 |
| 3,100,529 | 8/1963 | McStravick et al. | 166/52 |
| 3,118,502 | 1/1964 | Cochran | 166/129 |
| 3,170,518 | 2/1965 | Brown | 166/313 |
| 3,223,168 | 12/1965 | Stone | 166/89 |
| 3,269,755 | 8/1966 | Yancey | 285/137 |
| 3,330,349 | 7/1967 | Owsley et al. . | |
| 3,330,355 | 7/1967 | Yancey | 166/46 |
| 3,330,360 | 7/1967 | Young | 166/313 |
| 3,653,435 | 4/1972 | Reistle, III et al. | 166/0.5 |
| 4,068,729 | 1/1978 | Peevey | 175/8 |
| 4,291,724 | 9/1981 | Miller | 166/366 |
| 4,396,075 | 8/1983 | Wood et al. | 175/79 |
| 4,415,205 | 11/1983 | Rehm et al. | 299/5 |
| 4,444,276 | 4/1984 | Peterson, Jr. | 175/61 |
| 4,573,541 | 3/1986 | Jossee et al. | 175/78 |
| 4,749,046 | 6/1988 | Gano | 166/366 |
| 4,822,212 | 4/1989 | Hall et al. | 405/227 |
| 5,145,004 | 9/1992 | Cornette | 166/313 |
| 5,560,435 | 10/1996 | Sharp | 175/5 |

FOREIGN PATENT DOCUMENTS

| | | | |
|---|---|---|---|
| 1254866 | 1/1961 | France | 166/313 |
| 2 229117 | 1/1974 | Germany . | |
| 2 220 015 | 12/1989 | United Kingdom . | |

OTHER PUBLICATIONS

"Brewster Wellhead Equipment," The Brewster Company, Inc., P.O. Box 1095, Shreveport, LA 71102, (Apr. 1967), pp. 1–26.

N. S. Avocato, J. R. Jackson, I. G. Jones and S. J. Murphy, "Optimising Slot Usage on a Minimum Facilities Platform," *SPE 30346,* presented at the Offshore Europe Conference, Aberdeen, Scotland, (Sep. 5–8, 1995), pp. 27–32.

M. E. Teel, "What's Happening in Drilling," pp. 25 and 36, World Oil, Nov. 1993.

*Primary Examiner*—Dennis L. Taylor

*Attorney, Agent, or Firm*—Jack L. Hummel; Jack E. Ebel

[57] ABSTRACT

A subterranean well system and a process for drilling and completing such a system from a first subterranean well bore which extends to the surface of the earth. A second well bore may be drilled from the first well bore and a first tubular of a multiple well drilling template can be positioned within the first well bore while a second tubular of the template can be positioned within both the first and second well bores. Additionally, a third well bore can be drilled from the first well bore and the first tubular can be further positioned therein. The first and second well bores can penetrate subterranean formation(s) or additional well bore(s) can be drilled from the first, second and/or third well bores so as to penetrate subterranean formations. A second multiple well drilling template may be utilized to drill such additional well bore(s) from the second or third well bores. Fluid is produced from subterranean formation(s) to the surface via said first, second, third and/or additional well bores and/or through production casing and/or tubing positioned therein.

112 Claims, 22 Drawing Sheets

APPARATUS AND PROCESS FOR DRILLING AND COMPLETING MULTIPLE WELLS

CROSS-REFERENCE TO RELATED APPLICATIONS

This application is a continuation-in-part of U.S. patent application Ser. No. 08/170,557, filed Dec. 20, 1993, now U.S. Pat. No. 5,458,199, which is a continuation-in-part of U.S. patent application Ser. No. 08/080,042 filed on Jun. 18, 1993, now U.S. Pat. No. 5,330,007, which is a continuation-in-part of U.S. patent application Ser. No. 07/936,972 filed Aug. 28, 1992 and now abandoned.

BACKGROUND OF THE INVENTION

1. Field of the Invention

The present invention relates to apparatus and processes for drilling multiple subterranean wells and for completing such wells via separate casings, and more particularly, to apparatus and process for drilling and completing such multiple wells which will allow such wells to be deviated at significant degrees of separation and/or to be drilled into and completed within separate subterranean formations or zones having varying reservoir pressure characteristics.

2. Description of Related Art

Increasingly, well bores are being drilled into subterranean formations at an orientation which is purposely deviated from true vertical by means of conventional whipstock technology or a mud motor secured in the drill string adjacent the drill bit. In fractured subterranean formations, deviated wells are utilized to increase the area of drainage defined by the well within the subterranean formation, and thus, increase production of hydrocarbons from the subterranean formation. An inherent problem in utilizing a conventional whipstock to drill a deviated well is that both the depth and radial orientation of the whipstock is set when the whipstock is positioned in the well bore and cannot be changed without retrieving the whipstock from the well bore and changing the depth and/or radial orientation thereof.

In addition, wells drilled from offshore drilling platforms are usually deviated to increase the number of wells which can be drilled and completed from a single platform. Offshore drilling platforms which are utilized in deep water to drill and complete wells in a subterranean formation vary in size, structure, and cost depending upon the water depth and the loads in which the platform will be set. For example, a platform may be constructed to be supported in part by one leg or caisson which extends to the ocean floor or by as many as eight such legs or caissons. Costs of such offshore drilling platforms vary from approximately $5,000,000 to $500,000,000. Each offshore drilling platform is equipped with a set number of slots via which deviated wells can be drilled and completed through surface casing which is secured at the mudline by conventional techniques.

Due to the significant capital expenditure required for these offshore platforms, templates and processes for drilling and completing multiple wells via a single surface or intermediate casing have been developed. To achieve the most economic development of subterranean hydrocarbon reserves, it may be desirable to drill and complete wells into distinct subterranean formations or zones which can be located at depths differing by up to 10,000 feet or more. Subterranean formations or zones of differing depths often contain fluids at greatly differing pressures which are produced therefrom at significantly different flow rates. Although the templates which have been developed can be utilized to drill and complete subterranean wells into distinct formations or zones of varying depths, these templates are not designed to accommodate casing of a diameter, e.g. 7 inches, which is sufficient to enable fluids to be produced at a rate and/or volume necessary to render a relatively deep well profitable. Thus, a need exists for apparatus and processes to drill and complete multiple subterranean wells from a well bore into a plurality of subterranean formations or zones at differing depths. A further need exists for an apparatus and process to drill and complete multiple subterranean well bores at greater degrees of separation from each other thereby significantly increasing the area of drainage and thus enhancing hydrocarbon recovery from the well.

Accordingly, it is an object of the present invention to provide a template and process for drilling and completing multiple subterranean wells to significantly different true vertical depths via a single surface or intermediate casing and for completing such multiple wells via separate casings positioned through the surface or intermediate casing.

It is another object of the present invention to complete such multiple, cased wells in a manner such that remedial operations can be conducted on one well while hydrocarbons from a subterranean formation or zone are simultaneously being produced from the other wells which are completed via separate casings positioned within the same surface or intermediate casing.

It is still another object of the present invention to provide a surface template and process for drilling multiple cased wells which have a high degree of separation without the use of a whipstock.

It is a further object of the present invention to provide such a template for drilling multiple cased wells which is relatively simple in construction, which permits casing of each multiple well to separately depend from the template, and which provides that separate casing of each multiple well may extend to the surface.

It is a still further object of the present invention to provide a template and process for drilling and completing multiple subterranean wells from a single surface or intermediate casing wherein at least one well of the multiple subterranean wells is drilled and completed to significantly greater depths than previously obtainable.

It is a still further object of the present invention to utilize a downhole or subsurface template to drill and/or complete multiple subterranean wells from a tubular of a multiwell surface template which is positioned in a subterranean environment.

SUMMARY OF THE INVENTION

To achieve the foregoing and other objects, and in accordance with the purposes of the present invention, as embodied and broadly described herein, one characterization of the present invention may comprise a subterranean well system and a process of drilling and completing same from a first subterranean well bore extending to the surface of the earth. A second subterranean well bore is drilled from the first well bore, and a first tubular of a drilling and completion template is positioned within the first well bore, while a second tubular of the template is positioned within both of the first and second well bores.

In another characterization of the present invention, a subterranean well system and a process for drilling and completing such a system from a first subterranean well bore which extending to the surface of the earth are provided. A second subterranean well bore and a third subterranean well bore are drilled from the first well bore. A first tubular of a drilling and completion template is positioned within both the first and second well bores, while a second tubular of the template is positioned within both the first and third well bores.

In yet another characterization of the present invention, a subterranean well system and a process for drilling and completing same from a first subterranean well bore which extends to the surface of the earth is provided. A second subterranean well bore and a third subterranean well bore are separately drilled from the first well bore. A fourth subterranean well bore is drilled from the second well bore, while a fifth subterranean well bore is drilled from the third well bore. A first tubular of a drilling and completion template is positioned within both the first and second well bores. A second tubular of the template is positioned within both the first and third well bores.

In a further characterization of the present invention, a subterranean well system and a process for drilling and completing such a system from a first subterranean well bore which extends to the surface of the earth is provided. A second subterranean well bore is drilled from the first well bore. A first tubular of a first template is positioned within the first well bore and a second tubular of the first template is positioned within both the first and second well bores. At least two wells are drilled from the second well bore through a second template which is secured to the second tubular.

BRIEF DESCRIPTION OF THE DRAWINGS

The accompanying drawings, which are incorporated in and form a part of the specification, illustrate the embodiments of the present invention and, together with the description, serve to explain the principles of the invention.

In the drawings:

FIGS. 5A–5I are partially cutaway, schematic views of the template of the present invention as utilized to drill and complete multiple subterranean wells;

DETAILED DESCRIPTION OF THE PREFERRED EMBODIMENTS

The process of the present invention can be practiced by utilizing either a downhole or subsurface multiple well template which is positioned within a well or a surface template which is positioned at an earthen or subsea surface or on an offshore platform and extends into a well. In one embodiment of the present invention, the process is conducted utilizing a downhole or subsurface template in conjunction with at least one tubular of a surface template.

Figure 1:
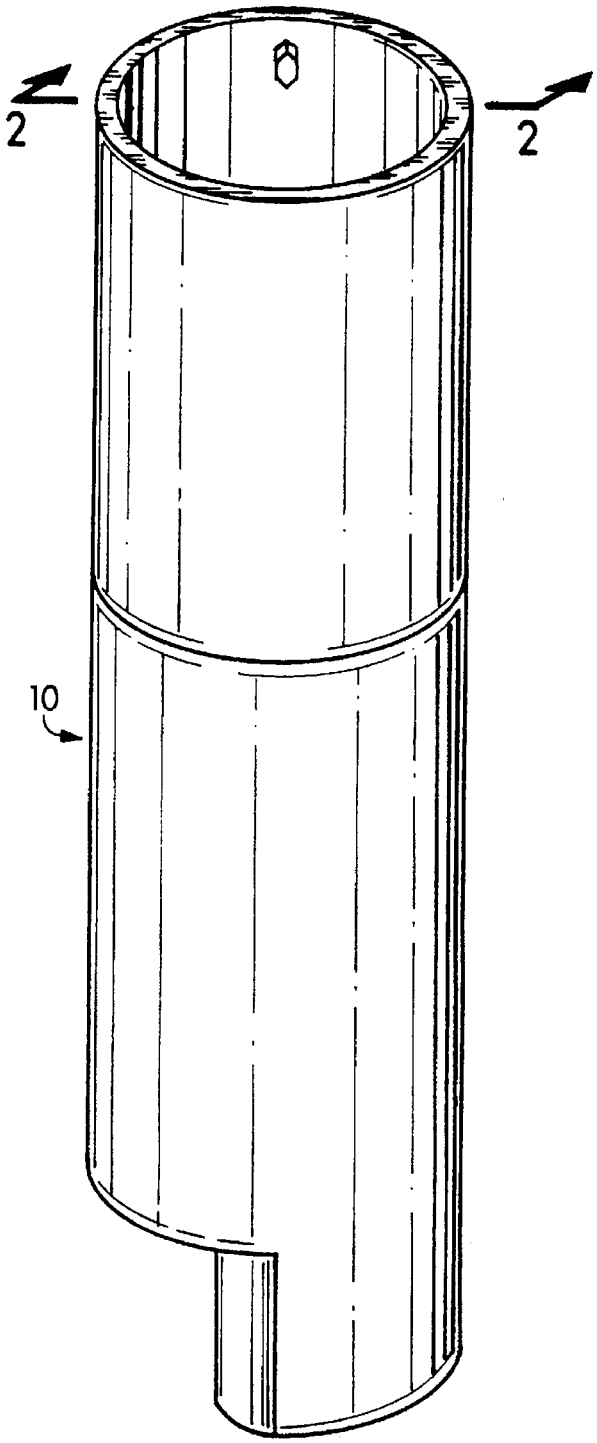
FIG. 1 is a perspective view of one embodiment of a downhole template for use in the present invention.

Referring to FIG. 1, a multiple well template or guide is illustrated generally as 10 and has a peripheral configuration which will permit the template to be positioned downhole within a well bore, as hereinafter described. Downhole template 10 may be unitary, but preferably is constructed of multiple sections which are secured together by any suitable means, such as screw threads, cam locks, and welds, and are sealed together by, for example, O-rings. Template 10 is preferably constructed from a suitable metal or combinations of metals, which are chosen based upon the loads and pressures to be encountered in the casing during use.

Figure 2:
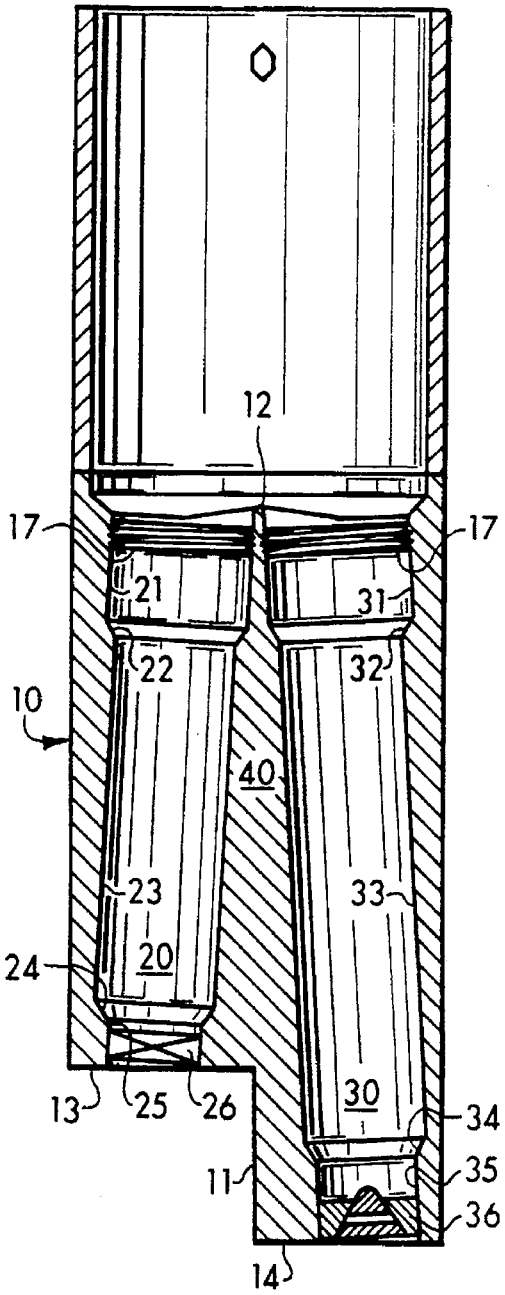
FIG. 2 is a sectional view of one embodiment of the downhole template of the present invention taken along the line 2—2 of FIG. 1.
Figure 3:
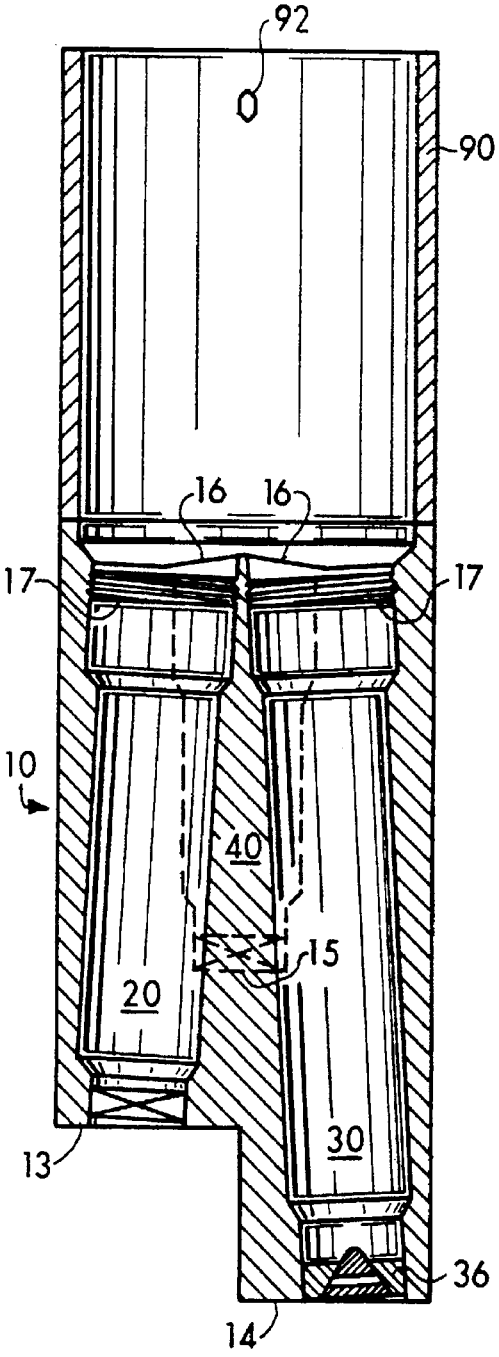
FIG. 3 is a sectional view of another embodiment of a surface template for use in the present invention.

As illustrated in FIG. 2, the downhole template 10 of the present invention has an end face 12 and two bores 20, 30 therethrough which intersect separate end faces 13 and 14 on the other end of the template. Surface 11 is defined between end faces 13, 14 and is dimensioned to permit a well to be drilled from the longer bore 30 into a separate and distinct subterranean zone of interest which may be at a depth of up to 10,000 feet or more greater than the zone drilled and completed through bore 20. As illustrated in FIG. 2, bores 20 and 30 extend and are offset along the entire axial length of template 10. Bores 20 and 30 are each provided with first sections 21, 31, second sections 23, 33 and third sections 25, 35, respectively. The first and second sections of bores 20, 30 define annular shoulders 22, 32 therebetween while the second and third sections of bores 20, 30 define annular shoulders 24, 34 therebetween. Each bore 20 and 30 is provided with screw threads 17 to releasably secure a riser or casing therein as hereinafter discussed. Bores 20, 30 may be arranged so as to diverge from each other from end face 12 toward end faces 13, 14 (FIGS. 2 and 3). Such divergence usually should not exceed 2° over the entire length of template 10, and preferably is less than 1°. A one way valve 36, such as a spring loaded float valve, is secured within third section 35 by any suitable means, such as by welds, while a plug 26 is secured within third section 25 to provide a fluid tight seal in bore 20.

The downhole template utilized in the present invention can be provided with three or more bores depending upon the diameter of the bore into which the template is positioned and the diameter of the well bores to be drilled using the template. As illustrated in FIG. 3, the downhole template or guide 10 is illustrated as having three generally cylindrical bores 20, 30 and 40 therethrough. End face 12 may be provided with a plurality of inclined facets or scoops 16 to assist in positioning a riser into bores 20, 30 and 40 during drilling operations as will be apparent to a skilled artisan. Each bore 20, 30 and 40 is provided with screw threads 17 to releasably secure a riser or casing therein as hereinafter discussed. In this embodiment, template 10 is provided with three separate end faces 13, 14 and 15 which are intersected by bores 20, 30 and 40, respectively and which are formed at different intervals along the longitudinal length of template 10, as illustrated in FIG. 3. As illustrated in FIG. 3, each of bores 20, 30 and 40 may also diverge from each other from end face 12 toward end faces 13, 14 and 15, although such divergence usually should not exceed 2° over the entire length of template 200, and is preferably less than 1°. When three bores are provided through the embodiment of the template illustrated in FIG. 3, bore 30 which is equipped with a one-way valve 36 will occupy a lowermost position with respect to inclined end face 12.

Figure 4:
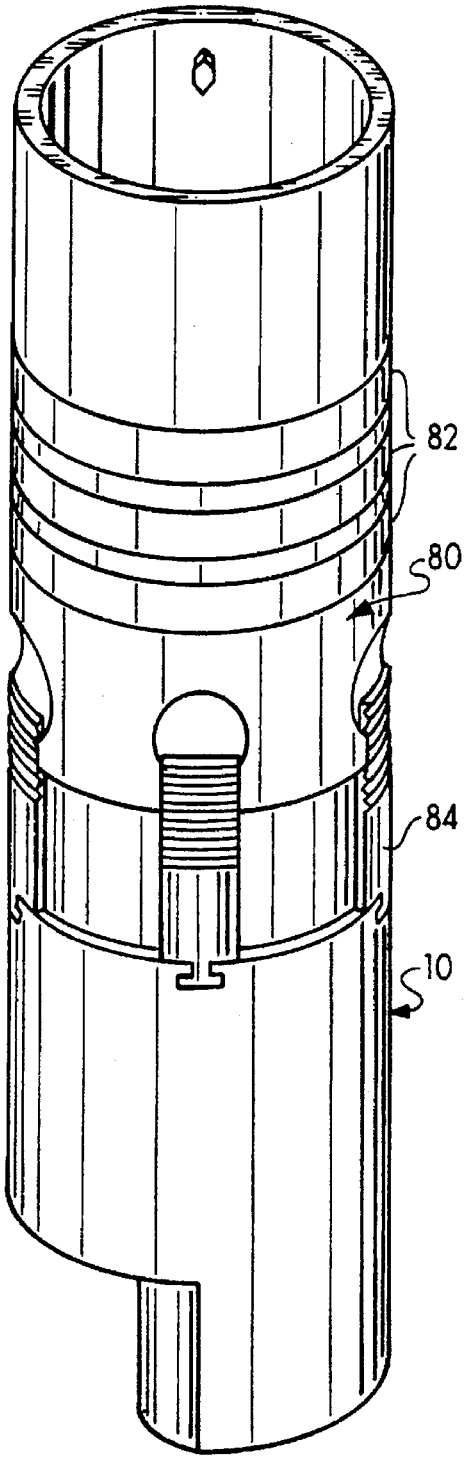
FIG. 4 is a perspective view of still another embodiment of the downhole template of the present invention.

Template 10 may be secured to the bottom of conductor, surface or intermediate casing 90 (FIGS. 2 and 3) by any suitable means, such as threads or welds. Casing 90 is provided with an inwardly extending key or dog 92 which is secured to casing 90, for example, by welds. Alternatively and as illustrated in FIG. 4, template 10 can be equipped with a conventional packer assembly 80 which is positioned about and secured to the periphery of assembly 80, preferably at the upper end of template 10 as positioned within well bore 54. Packer assembly 80 comprises a plurality of expandable, annular elastomeric elements 82 and a plurality of slip elements 84. In this embodiment, template 10 is sized to be received within a casing, and thus, can be lowered by means of a drill string, tubing string, or wireline (not illustrated) within surface or intermediate 90 which has been previously cemented within a well bore 54. Once positioned near the lowermost end of casing 90, slips 84 and elements 82 are sequentially expanded into engagement with surface or intermediate casing 90 in a manner and by conventional means as will be evident to a skilled artisan so as to secure template 10 within surface or intermediate casing 90 and seal the annulus therebetween. Slips 84 are sized and configured to support not only template 10, but also any well bore tubulars which may be suspended therefrom as hereinafter described.

Figure 6:
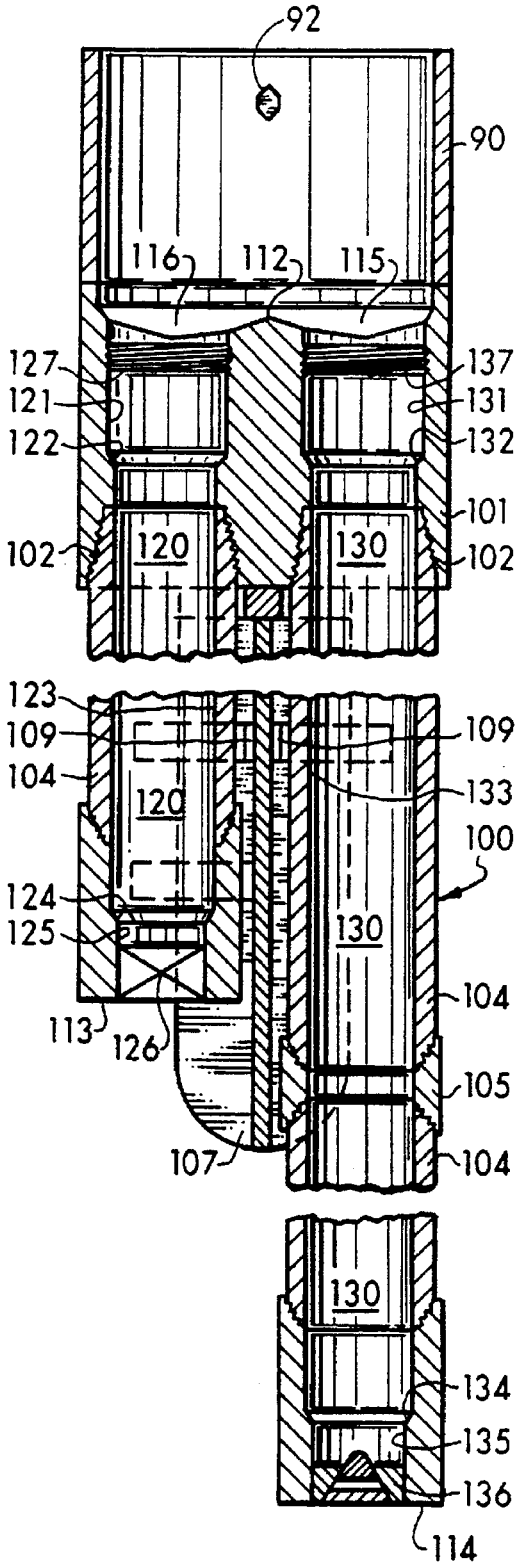
FIG. 6 is a cross sectional view taken along line 6—6 of FIG. 5.
Figure 7:
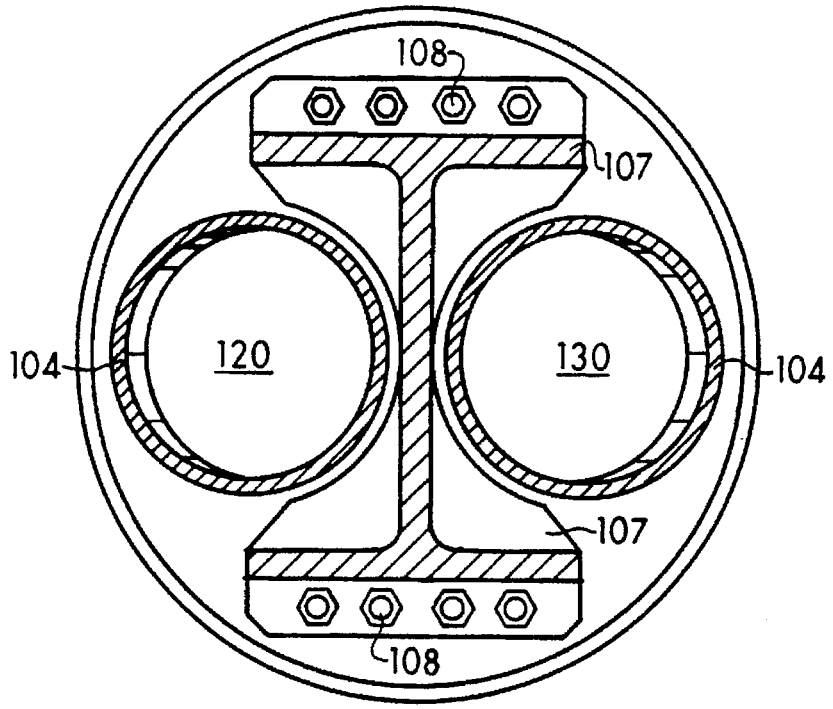
FIG. 7 is a cross sectional view taken along line 7—7 of FIG. 5.
Figure 8:
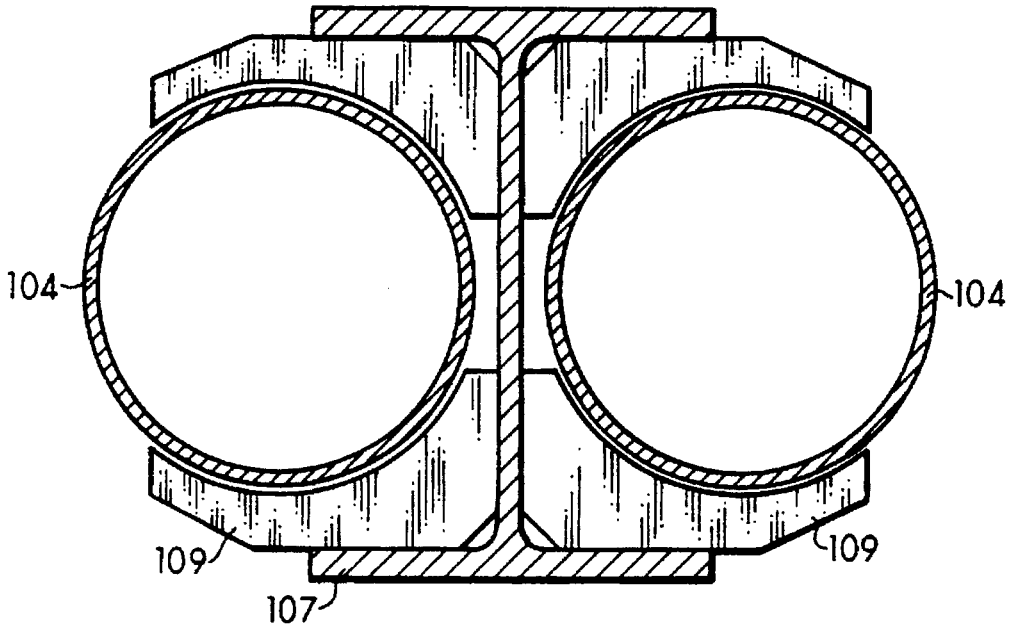
FIG. 8 is a cross sectional view taken along line 8—8 of FIG. 5.

As previously mentioned, the template of the present invention may be unitary or constructed of multiple sections. An example of a template of the present invention which is constructed of multiple sections is illustrated generally in FIGS. 5 and 6 as 100. Template 100 is comprised of a first upper section 101, an elongated frame 107, and a plurality of tubular members 104. First upper section 101 is provided with two bores therethrough having lower threaded sections 102. The end face 112 of first section 101 is formed with indentations 115, 116 surrounding the intersection of the two bores. An elongated frame, for example I-beam or H-beam 107, is secured to the other end face of first section 101 by any suitable means, such as bolts 108 (FIG. 7). Generally C-shaped guides 109 may be secured to I-beam or H-beam 107 along the length thereof such as by welds. Tubular members 104 am positioned through guides 109 on each side of I-beam or H-beam 107 (FIG. 8) and mated with threaded sections 102 of the bores through first section 101. Guides 109 function in combination with elongated frame 107 to restrain and inhibit movement of tubular member(s) 104 positioned through such guides. Different tubular members 104 positioned on the same side of I-beam or H-beam 107 are secured together by any suitable means, for example, threaded collars 105. The free end of each tubular member 104 is mated with a shoe 106 into which a float valve 136 is secured on one side of I-beam or H-beam 107 while a plug 126 is inserted into the other side of beam 107.

Figure 5:
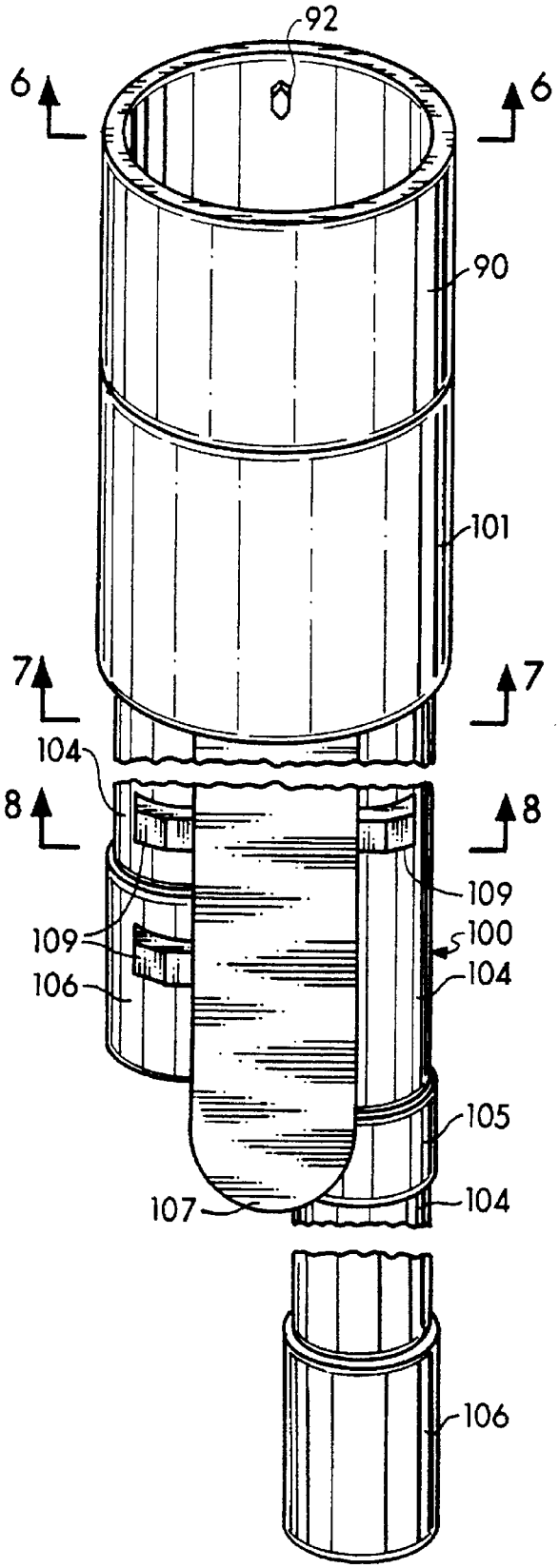
FIG. 5 is a perspective view of another embodiment of the template of the present invention.
Figure 12:
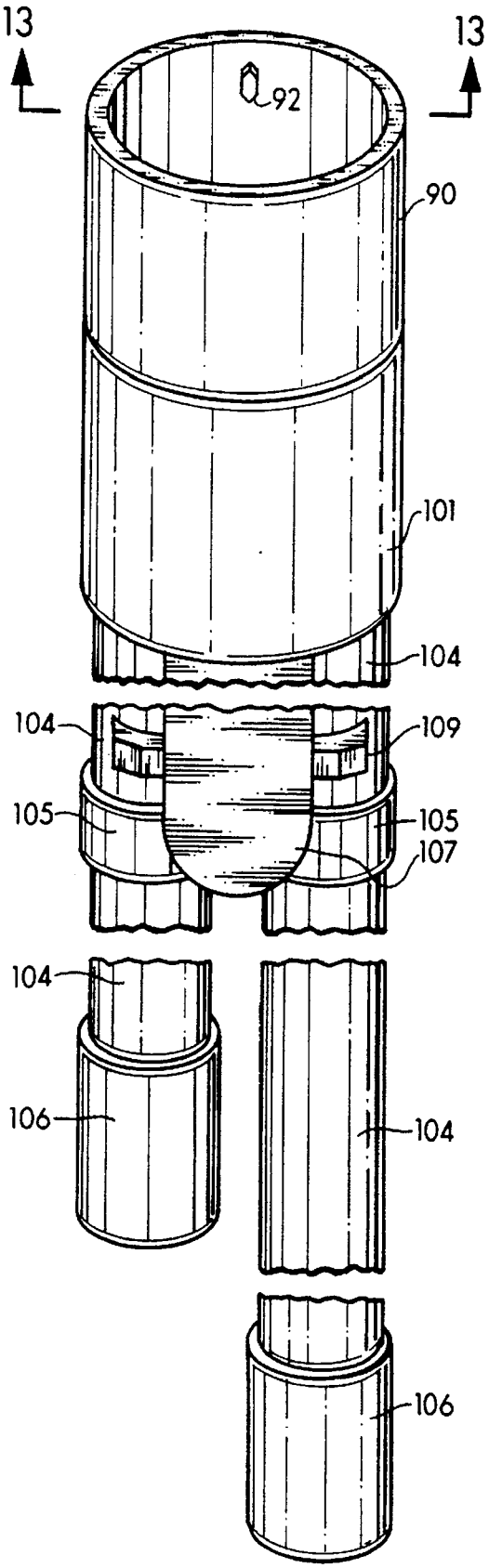
FIG. 12 is a perspective view of another embodiment of the template of the present invention.
Figure 13:
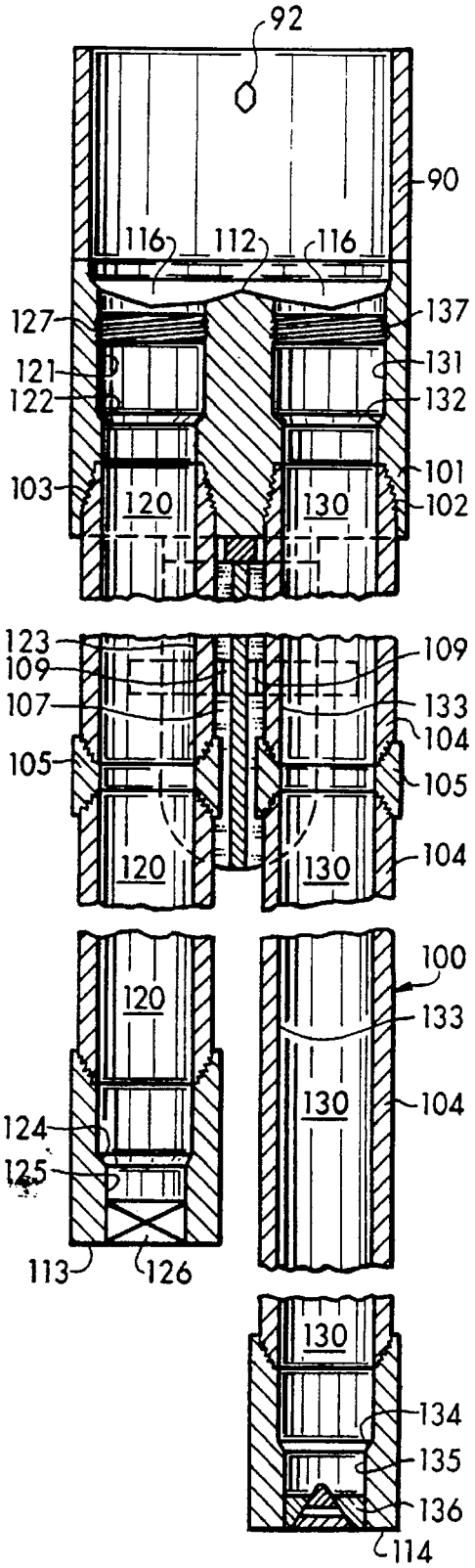
FIG. 13 is a cross sectional view take along line 12—12 of FIG. 12.

As thus assembled, first section 101, beam 107 and tubular members 104 define a template 100 having two generally cylindrical bores 120, 130 therethrough. Exemplary of the relative dimensions of template 100, the length of first section may be 4 feet, beam 107 may be 30 feet, and intermediate or surface casing 90 may be 8 feet. Bore 120, as measured from the bottom of first section 101 to end face 113, may be of a length approximating, i.e. up to 30 feet or less, that of beam 107 (as illustrated in FIGS. 5 or 6) or may significantly extend beyond beam 107 up to several thousand feet or more (as illustrated in FIGS. 12 and 13), Bore 130 is longer than bore 120 and, as measured from the bottom of first section 101 to end face 114, may be up to 10,000 feet or more depending upon the formations to be drilled and completed in accordance with the present invention. As illustrated in FIG. 6, bores 120, 130 are each provided with first sections 121, 131, second sections 123, 133, and third sections 125, 135, respectively. The first and second sections of bores 120, 130 define annular shoulders 122, 132 therebetween while the second and third sections of bores 120, 130 define annular shoulders 124, 134 therebetween. In this embodiment, bores 120, 130 will usually diverge from each other. In the embodiment illustrated in FIGS. 5 and 6, bore 120 is shorter than bore 130 to provide a portion of subterranean formation between end faces 113 and 114 within which the drill string emanating from bore 120 may be deviated so as to minimize the possibility of interference between well bores which are drilled and completed in accordance with the present invention. One side of I-beam 107 may be provided with a kick pad secured thereto below bore(s) 120 by any suitable means, such as welds, to further assist in minimizing interference between the well bores drilled utilizing template 100 of the present invention.

Figure 10:
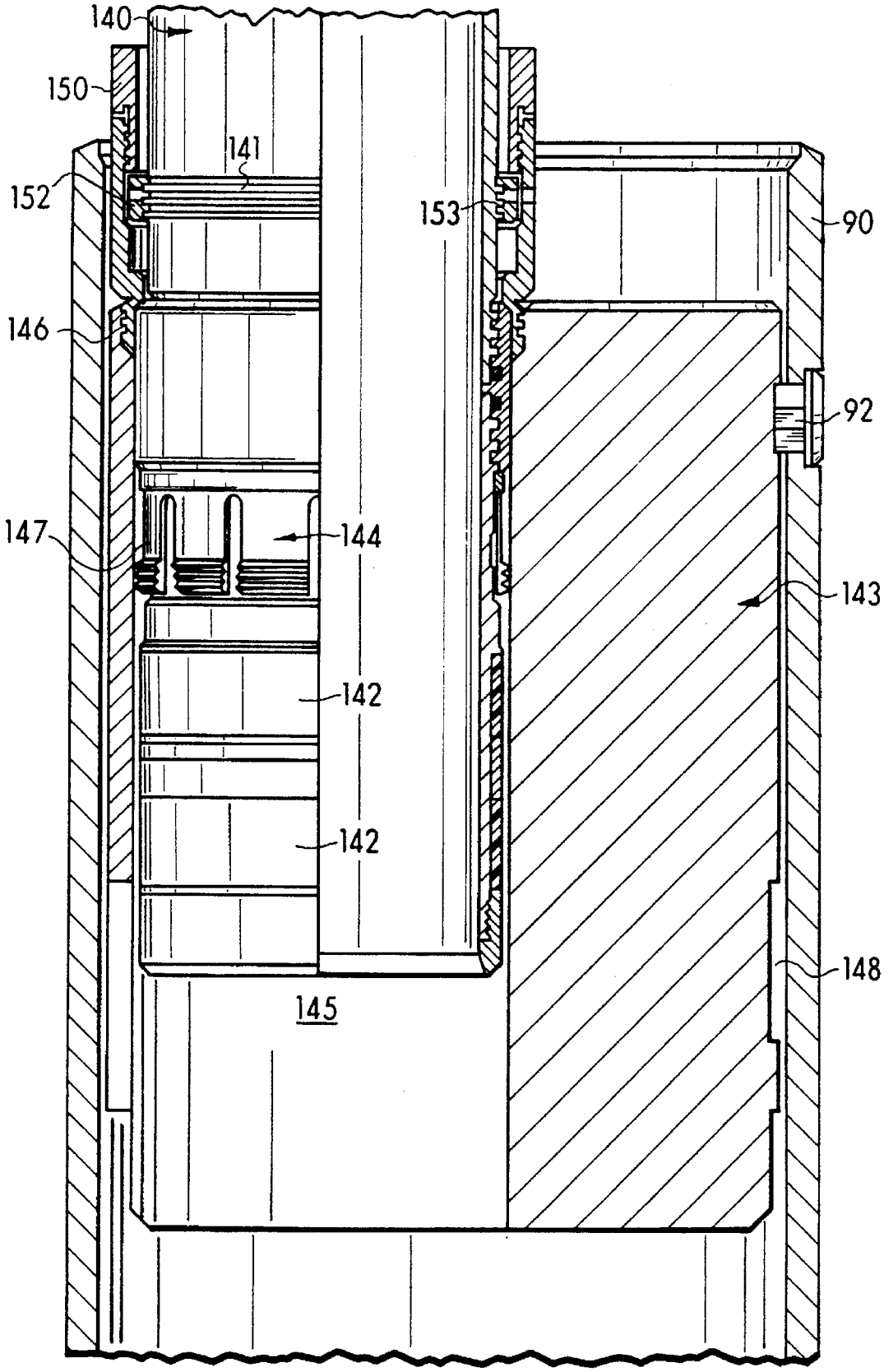
FIG. 10 is a partially cutaway, perspective view of the preferred riser illustrated in FIG. 9.

An orienting cam 143 is provided with an axially offset bore 145 therethrough (FIG. 10) which in turn is provided with threads 146 near the upper end thereof to which a generally tubular housing 150 is releasably secured. Housing 150 is provided with an expandable lock ring 152 having a threaded internal diameter 153 and positioned within a circumferentially extending groove in bore 145. Lock ring 152 is split in a manner evident to a skilled artisan to permit expansion when an article of sufficient diameter is inserted through the ring. Threads 141 and/or threaded internal diameter 153 can be tapered to permit their full engagement. A riser 140 is illustrated as having a plurality of annular seals 142, for example moly glass seal rings such as manufactured by Baker Oil Tools, and a collet 144 having a plurality of fingers 147. Each finger is biased outwardly and a corresponding portion of the external surface of each finger is threaded. Above collet 144, the external surface of riser 140 is provided with threads 141. As cam 143 and riser 140 are assembled for entry into a well bore, threaded section 141 of riser 140 is engaged with the internal threads of lock ring 152.

Figure 9:
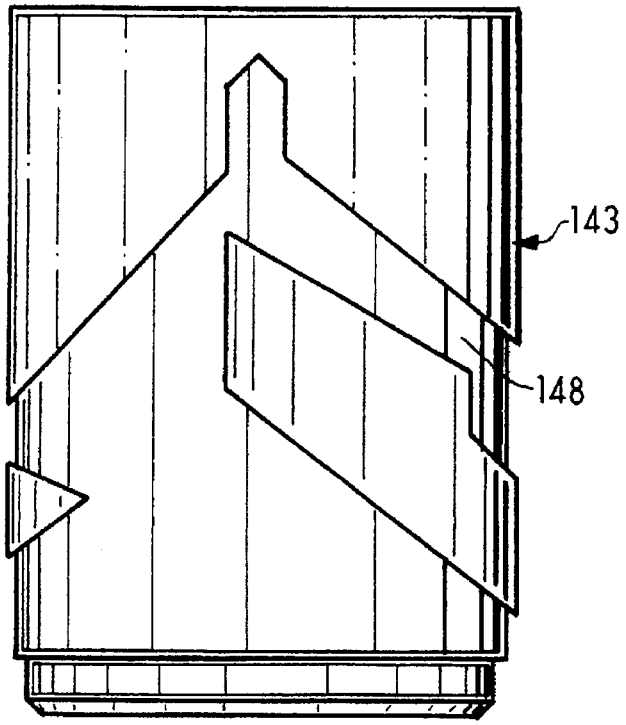
FIG. 9 is a perspective view of a preferred riser utilized in conjunction with the template of the present invention.
Figure 11:
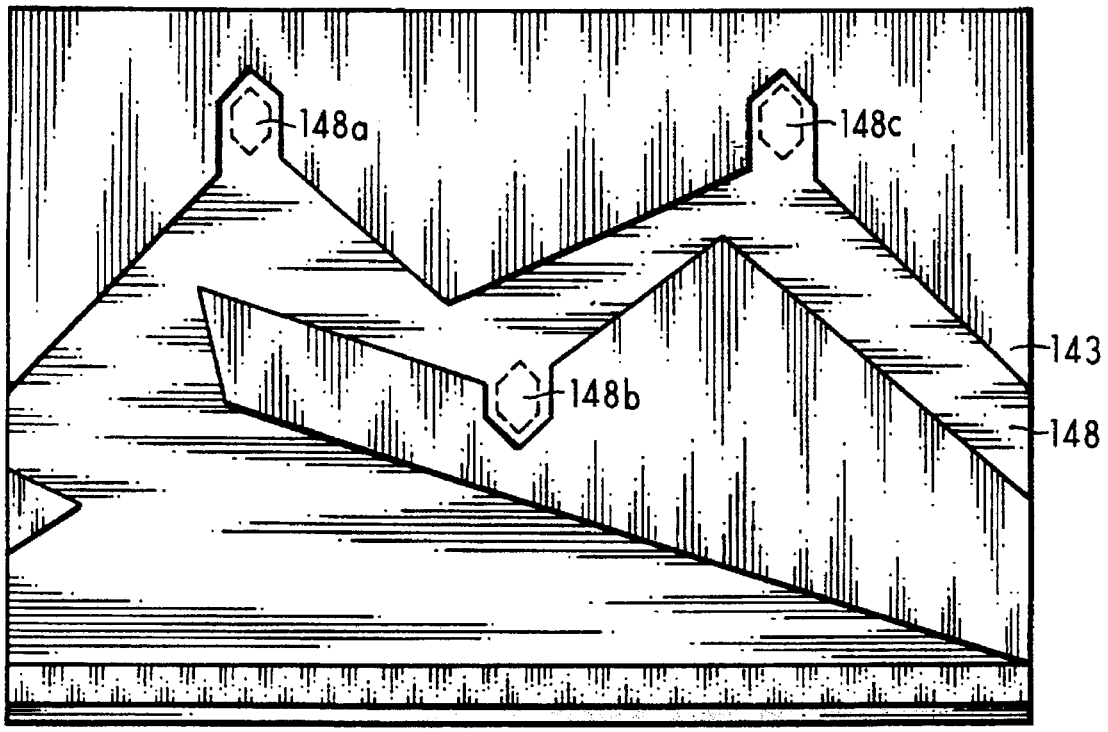
FIG. 11 is a 360° expanded view of the external surface of the preferred riser of the present invention.

As illustrated in FIGS. 9 and 11, the external surface of cam 143 is provided with a J-4 slot 148 which in conjunction with key 92 functions to orient riser 140 for insertion into either bore 120 or 130 in a manner hereinafter described.

Figure 14A:
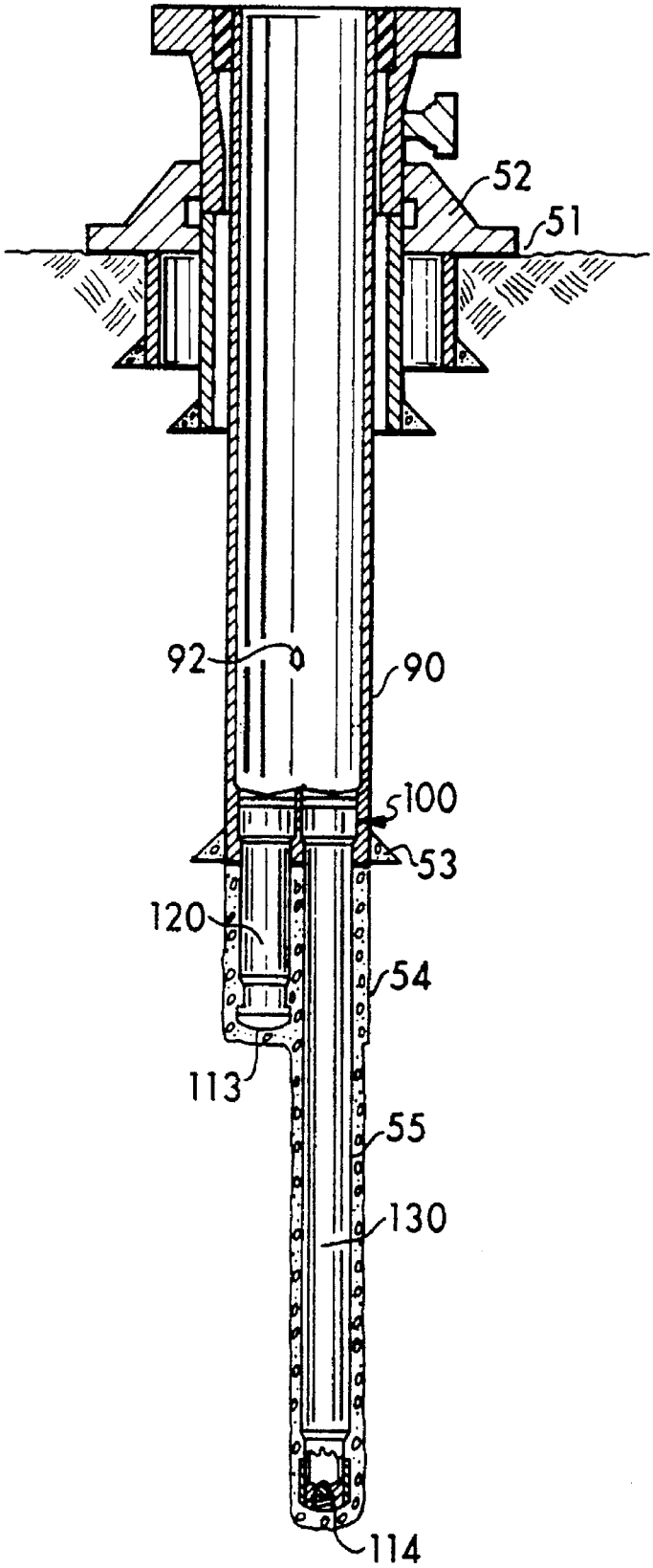
FIGS. 14A–14F are partially cutaway, schematic views of the downhole template as utilized to drill and complete multiple subterranean well in accordance with the process of the present invention.

In accordance with one embodiment of the process of the present invention, a first well bore 54, e.g. a 24 diameter inch well bore, is drilled from the surface of the earth to a depth up to about 5000 feet or more. Thereafter, a second well bore, e.g. a 12¼ inch diameter well bore, is drilled from the first well bore in a manner as will be evident to a skilled artisan to a depth, for example of about 13,500 feet or more. The downhole template 100 is secured to the bottom of surface or intermediate casing 90 and positioned within a well bore 54 such that end face 113 of bore 120 is positioned adjacent the bottom of well bore 54 and end face 114 of bore 130 is positioned within well bore 55, preferably adjacent the lower end thereof (FIG. 14A). The surface or intermediate casing is anchored in well bore 54 in a conventional manner by means of cement 53. Well bore(s) 54, 55 can be generally vertical or deviated. Surface or intermediate casing 90 extends to the surface of the earth 51 thereby defining a well head 52. Thereafter, the portion of tubular members 104 which define bore 130 and which extend downwardly within well bore 55 may be cemented within bore 55 by circulating cement downwardly through bore 130 and float valve 136 and upwardly in the annulus defined between tubular members 104 and well bore 55 in a conventional manner. The cement circulated in this manner may also be utilized to cement the portion of tubular members 104 which define bores 120 and 130 within well bore 54. Alternatively, bore 120 may be equipped with a float valve and cement can be circulated downwardly through bore 120 and the float valve and upwardly in the annulus defined between tubular members 104 and well bore 54 (and also casing 90 and well bore 54) in a conventional manner to cement the tubular members which define bores 120 and 130 in well bore 54. Thereafter, bores 120 and 130 can be placed in fluid communication with subterranean formations or zones which are vertical segregated from each other by any suitable means, such as a perforating gun. In completing bore 120, the perforating gun must selectively fire projectiles away from bore 130 so as not to damage the latter. Fluids, particularly hydrocarbons, may then be produced from subterranean formations separately through bores 120 and 130. These fluids can be commingled and produced through casing 90 to the surface or alternatively, either or both of bores 120 and 130 may be provided with production casing and/or tubing to separately produce fluids to the surface.

Figure 14B:
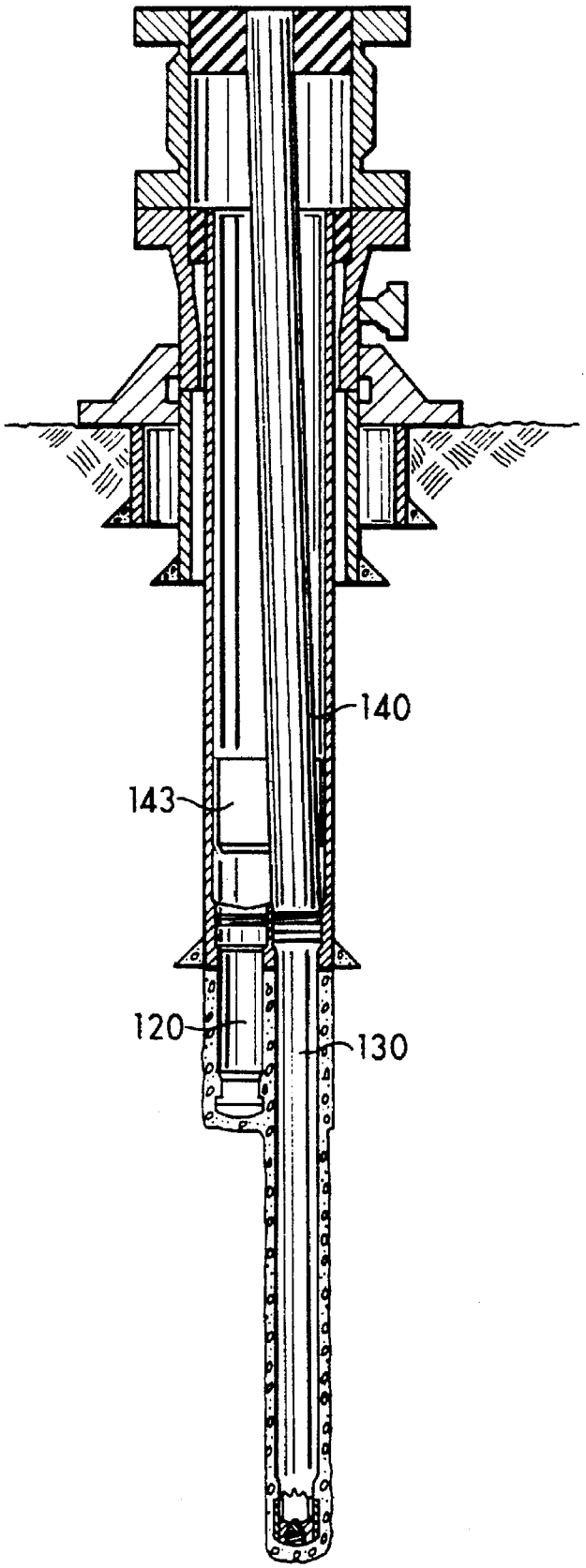
Figure 14C:
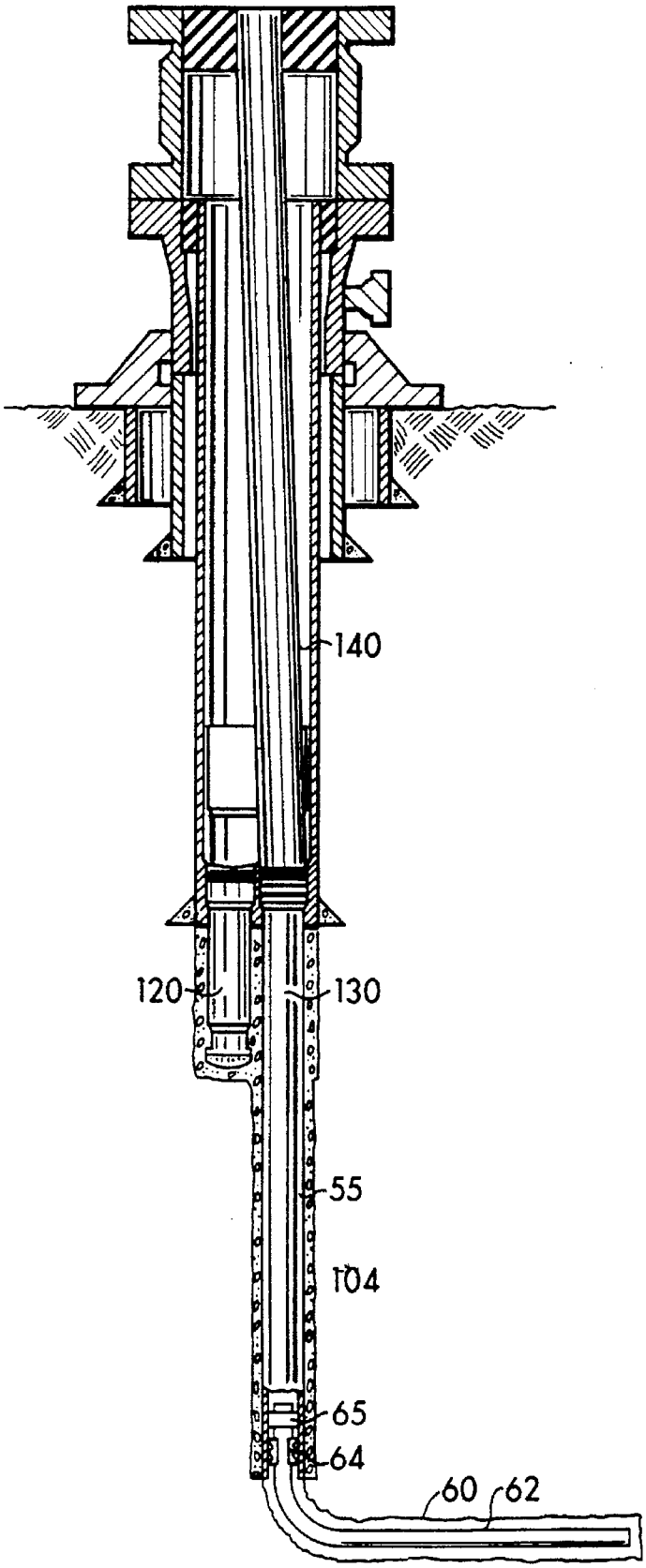

In accordance with one embodiment of the present invention, tubular riser 140 and orienting cam 143 are lowered within surface or intermediate casing 90 until key 92 contacts slot 148 in the external surface of cam 143. The inclined surfaces of slot 148 will cause cam 143 and riser 140 to rotate until key 92 assumes position 148*a* as illustrated in FIG. 11. As thus oriented, riser 140 will be aligned with bore 130. Rotation of riser 140 from the surface will cause the threaded external surface 141 deer 140 to disengage from threaded internal diameter 153 of expandable lock ring 152. Riser 140 is then lowered into bore 130 of template 100 until collet fingers 147 engage threaded section 137 of bore 130 (FIG. 14B). Once the collet fingers are engaged in the template, the riser is then secured to the well head in a manner as will be evident to a skilled artisan. A first well bore 60 may be drilled from well bore 55 by means of a conventional drill string including a drill bit and mud motor (not illustrated) transported through riser 140 and bore 130 in a conventional manner as will be evident to the skilled artisan with drilling mud and formation cuttings being circulated out of well bore 55 to surface 51 via bore 130 of template 100 and riser 140. Although illustrated in FIG. 14C as deviated, first well bore 60 can also be drilled in a generally vertical orientation. Thereafter, the drill string is withdrawn from riser 140 and liner 62 is lowered through riser 140 and is secured to template 100, and thus surface or intermediate casing 90, by means of conventional liner hanger 64. In a preferred embodiment, liner hanger 64 is seated upon and is supported by annular shoulder 134 (FIG. 13). Liner hanger 64 includes an expandable packer 65 to seal the annulus between the liner hanger and bore 130 and expandable slips 67 to assist in securing hanger 64 within second section 133 of bore 130. Depending upon the total load supported by annular shoulder 134, slips 67 may not be needed to assist in supporting such load. Casing 62 can be cemented within first well bore 60.

Figure 14D:
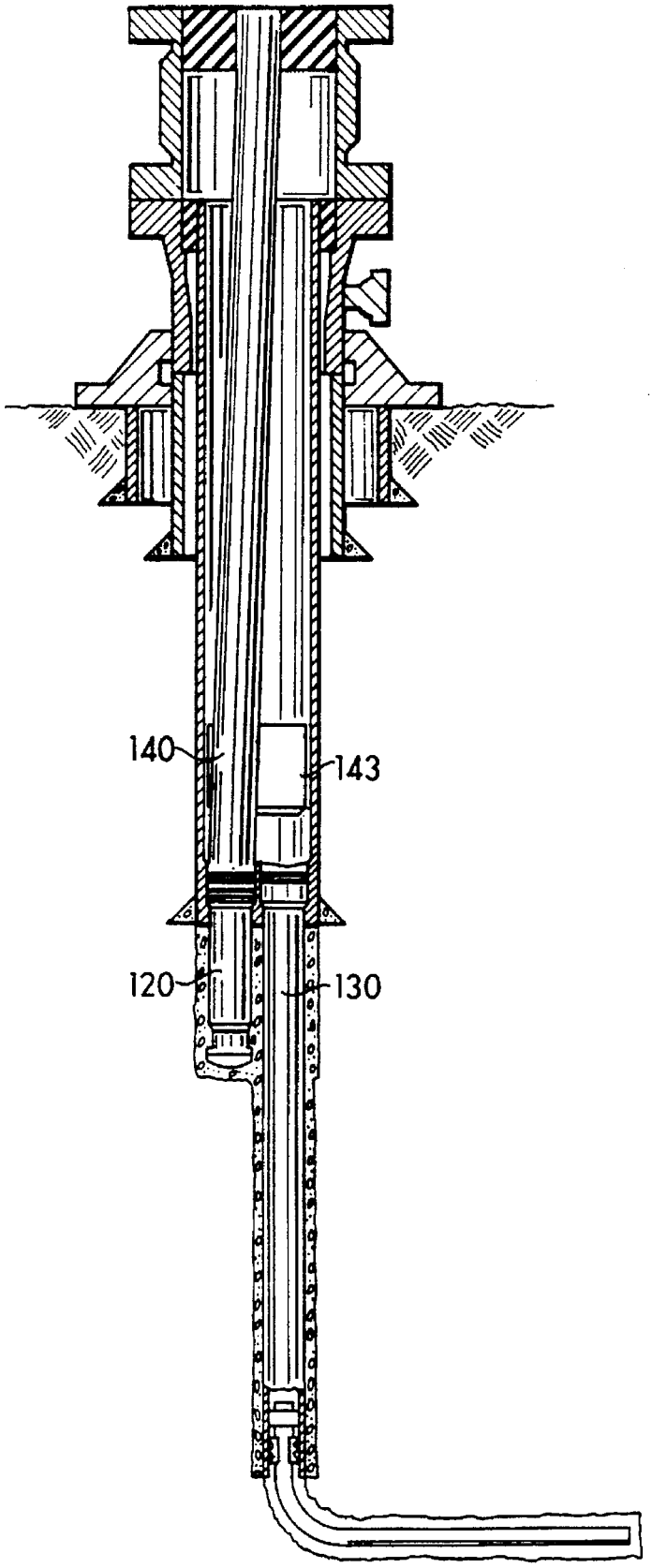

Riser 140 is released from the wellhead, placed in tension, and rotated to disengage the threaded external surfaces of collet fingers 147 from threaded section 137 of bore 130 so as to permit riser 140 to be raised into cam 143 and secured by automatically engaging threaded external surface 141 of riser 140 with threaded internal diameter 153 of expandable lock ring 152. The riser is then raised from the surface and engagement of key 92 within slot 148 causes the riser and cam 143 to automatically rotate until key 92 to assumes position 148*b* within slot 148. Subsequent lowering of riser 140 causes the riser and cam to rotate until key 92 is positioned at 148*c* within slot 148. In this orientation, riser 140 will be aligned with bore 120. Rotation of riser 140 from the surface will cause the threaded external surface 141 of riser 140 to threadably disengage from threaded internal diameter 153 of expandable lock ring 152. Riser 140 is then lowered into bore 120 of template 100 until collet fingers 147 engage threaded section 127 of bore 120 (FIG. 14D). Once the collet fingers are engaged in the template, the riser is then secured to the well head in a manner as will be evident to a skilled artisan.

Figure 14E:
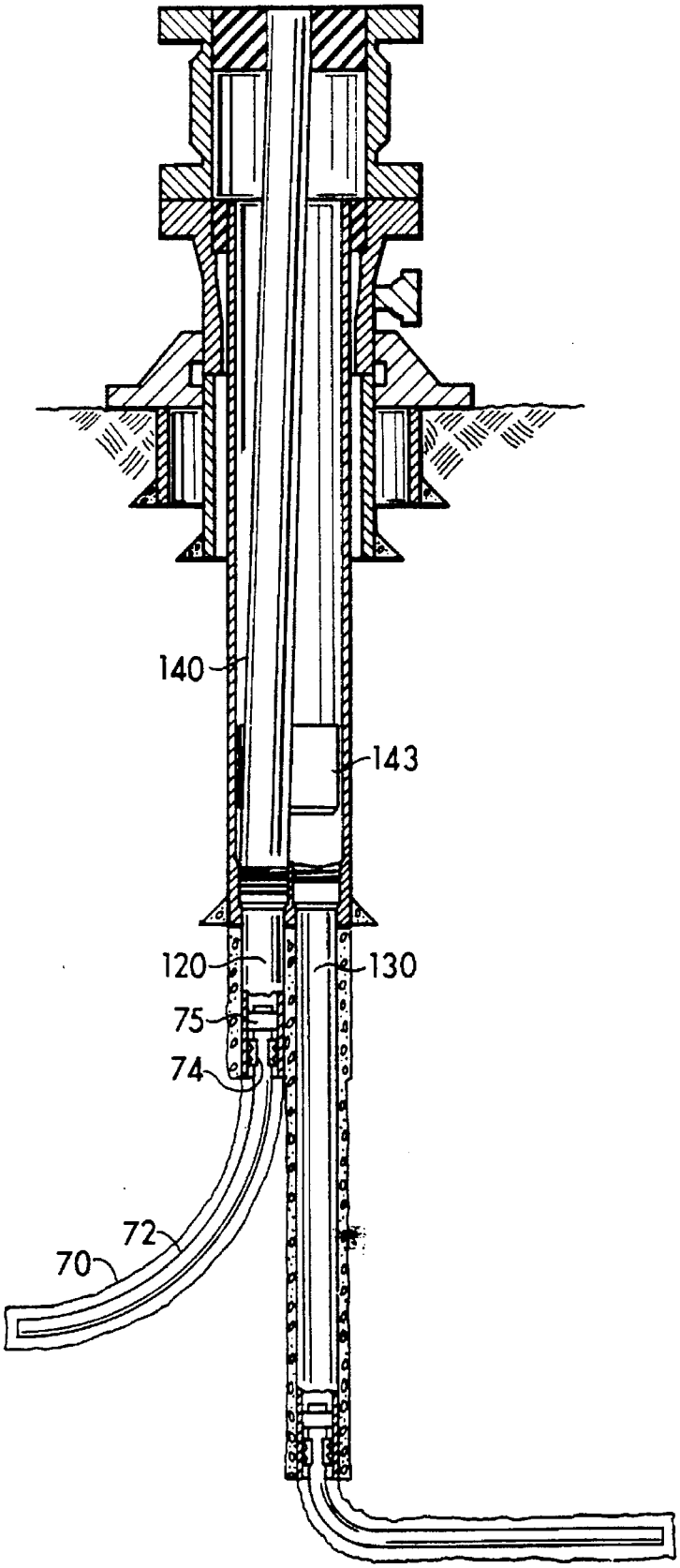

A drill string is then transported via riser 140 into bore 120 and plug 126 is drilled out. The drill string is passed through bore 120 and a second well bore 70 is drilled. Although illustrated in FIG. 14E as deviated, second well bore 70 can also be drilled in a generally vertical orientation, usually if first well bore 60 was deviated. Thereafter, the drill string is withdrawn from riser 140 and casing 72 is lowered through riser 140 and is secured to template 100, and thus surface or intermediate casing 90, by means of conventional liner hanger 74 (including an expandable packer and slips). Liner hanger 74 is seated upon and supported by annular shoulder 124 while packer 75 is expanded to seal the annulus between the liner hanger and bore 120 and slips 77 can be expanded when necessary to assist in securing hanger 74 within second section 123 of bore 120 (FIG. 14E). Casing 72 can be cemented within second well bore 70 as will be evident to the skilled artisan.

Riser 140 is then released from the well head, placed in tension, and rotated to disengage the threaded external surfaces of collet fingers 147 from threaded section 127 of bore 120 so as to permit riser 140 to be raised into cam 143 and secured thereto by automatically engaging threaded external surface 141 of riser 140 with threaded internal diameter 153 of expandable lock ring 152. The riser is raised from the surface and engagement of key 92 within slot 148 causes key 92 to disengage from slot 148 and the riser 140 and orienting cam 143 are raised to the surface.

Figure 14F:
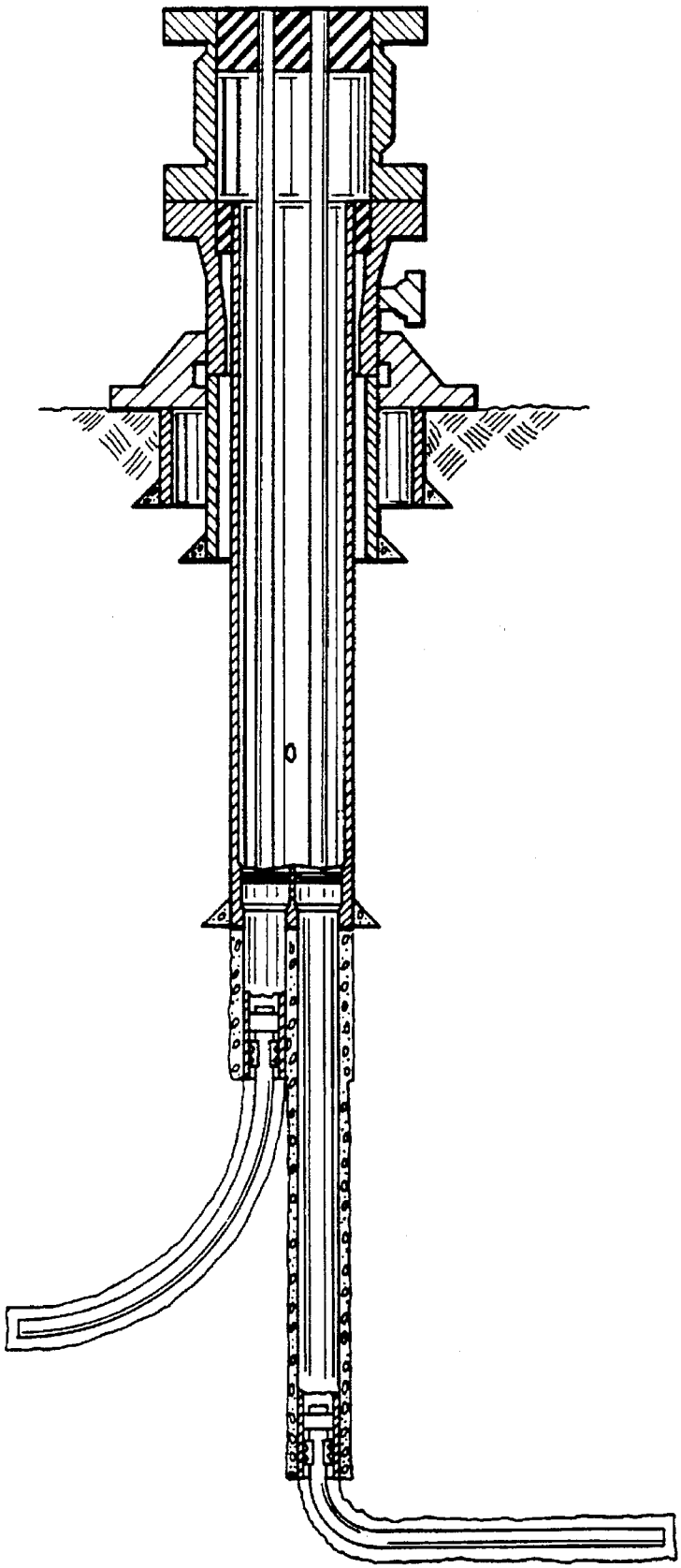

Liners or casings 62, 72 are placed in fluid communication with a subterranean formation(s) by any suitable means, such as by perforations. Fluids produced from subterranean formation(s) into well bores 60 and/or 70 may be separately produced through liners or casings 62, 72 to casing 90 where the fluids are commingled and produced to the surface. Alternatively, production casings 66, 76 may be sequentially, sealingly secured to casings 62, 72 or bores 120, 130 respectively (FIGS. 14F) by means of seals secured to and positioned around the lower end of casings 66 and 76. Casings 66, 76 are secured and supported at well head 52 by a conventional split hanger system (not illustrated) and are separated into distinct casinghead connections or trees by a tubing spool (not illustrated) as will be evident to a skilled artisan. Thereafter, casings 62, 72 are placed in fluid communication with a subterranean formation(s) by any suitable means, such as by perforations, and fluids, such as hydrocarbons, can be produced from the formation to the surface via casings 62, 66 and/or casings 72, 76 (FIG. 14H). Depending upon the application, a conventional production tubing can be inserted into casings 62, 72 and conventional packers may be utilized to seal the annulus between such production tubing and casing against fluid flow so as to permit the production of fluids, such as hydrocarbons, to the surface via the production tubing. In accordance with the present invention, either first well bore 60 or second well bore 70 need not be drilled and completed. If the first well bore 60 is not drilled, bore 130 of template 100 is completed within well bore 55 in a manner as previously discussed. If second well bore 70 is not drilled, bore 120 of template 100 is completed within well bore 54 in a manner discussed above. As thus completed in accordance with the present invention, a remedial operation including, but not limited to work overs, recompletions, and side tracking, can be performed in one well while fluids, such as hydrocarbons, are simultaneously produced from the other well. In addition, fluid can be injected into a subterranean formation via one well as hydrocarbons are being produced from the same or a different subterranean formation via the other well.

Figure 15:
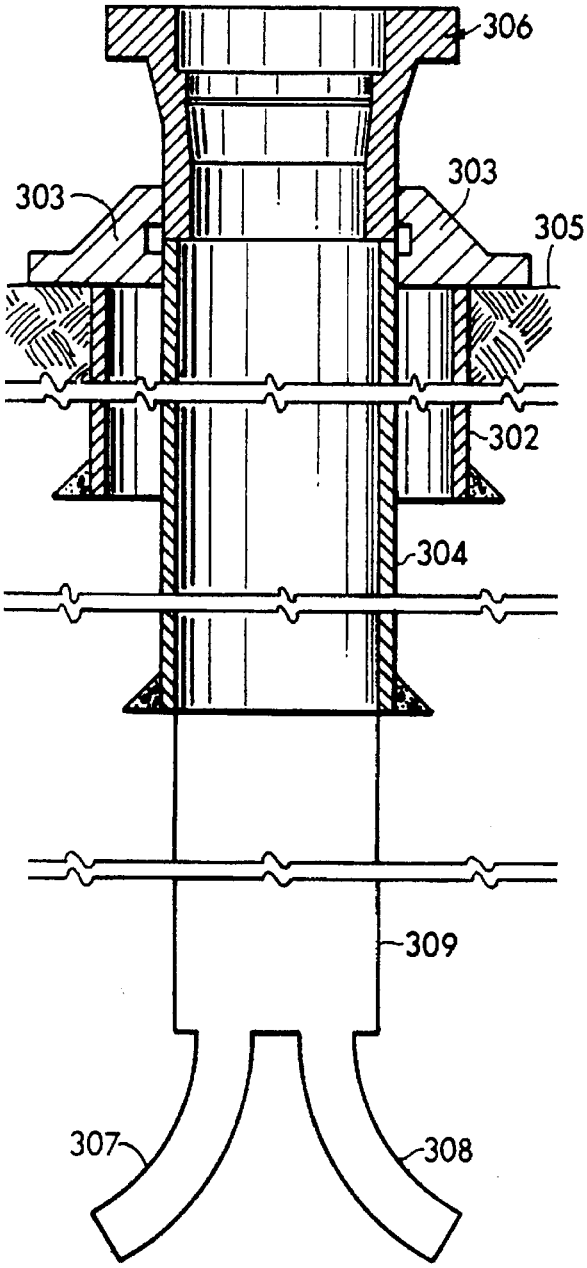
FIG. 15 is a sectional view of a surface template for use in the present invention as positioned over a well bore.

A multi well template 300 which is positioned at an earthen or subsea surface and extends into a subterranean well bore can also be utilized to practice the present invention. As illustrated in FIG. 15, a relatively large diameter tubular or pipe 302, for example a 30 inch diameter pipe, is driven into the ground, either onshore or offshore, by percussion or any other suitable means to a relatively shallow depth at which the pipe refuses to be driven. Alternatively, a large diameter hole, for example a 36 inch diameter hole, can be drilled into the earth by any conventional means as will be evident to a skilled artisan and the relatively large diameter tubular or pipe 302, for example a 30 inch diameter pipe, is positioned within the hole and cemented therein. Thereafter, a slightly smaller diameter well bore is drilled through pipe 302 to a depth of, for example 1200 feet, and conductor pipe 304 is positioned and cemented within this well bore in a conventional manner as will be evident to a skilled artisan. A wellhead 306 having a plurality of legs or pads 303 is positioned upon pipe 302 and casing 304 such that the bottom of legs 307 rest upon the upper end of pipe 302 and either the surface of the earth if onshore or the cellar deck of an offshore drilling platform or the subsea surface, which are all illustrated as 305 in FIG. 15. The upper end of conductor pipe 304 is received within wellhead 306 and secured thereto by any suitable means, such as welds (not illustrated). The well bore is then drilled through casing 304 to an appropriate depth, e.g., about 3500–4000 feet. The resultant well bore 309 may either be vertical or deviated. In accordance with the present invention, a first well bore 307 which may be either vertical or deviated is then drilled from well bore 309 from any point along the length thereof. A second vertical or deviated well bore 308 may also be drilled from well bore 309 from any point along the length thereof.

Figure 16:
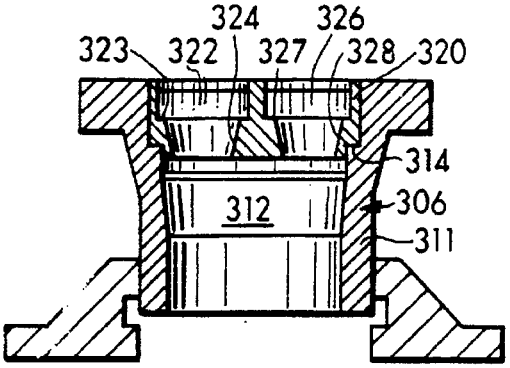
FIG. 16 is a sectional view of a dual bore insert as positioned in and supported by the surface template utilized in one embodiment of the present invention.
Figure 17:
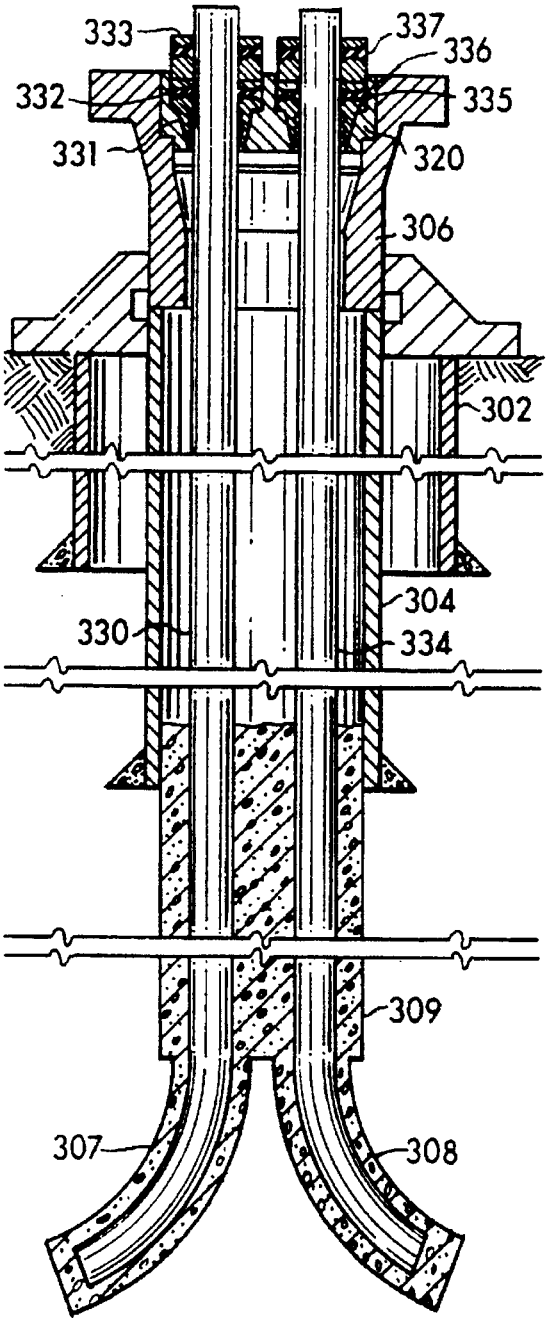
FIG. 17 is a sectional view of the surface template utilized in the present invention illustrating two tubulars depending from the wellhead and extending into separate subterranean well bores drilled from a common well bore.

Referring to FIG. 16, wellhead 306 has a bore 312 therethrough of varying diameter which defines a generally annular shoulder 314. An insert 320 is positioned within bore 312 and supported upon generally annular shoulder 314. Insert 320 has at least two bores 322, 326 therethrough of varying diameter which define generally annular shoulders 323, 327 and tapered sections 324, 328, respectively. As illustrated in FIG. 17, a plurality of tubulars 330, 334 which is less than or equal to the number to the number of bores through insert 320 and corresponds to the number of wells to be drilled and completed in accordance with the present invention are positioned through bores 322 and 326 in a manner as hereinafter described and are secured therein by, for example, conventional casing slips 331, 335 which are expanded into engagement with insert 320 upon being lowered into contact with tapered sections 324, 328, respectively. Casing slips 331, 335 are provided with seals 332, 336 which can be constructed of any suitable material, for example an elastomer. Any other conventional means, such as split mandrel hangers, can be utilized in lieu of casing slips 331, 335 to secure tubulars 330, 334 to insert 320. Tubulars 330, 334 are also provided with conventional packoff seal rings 333, 337. Tubular 334 extends through well bore 309 and into well bore 308. Tubular 330 extends at least into well bore 309 and may extend into well bore 307 if the latter is drilled. Tubulars 330, 334 may be of substantially the same or of differing lengths. As utilized throughout this description, "tubular" refers to string of pipe, such as casing, conventionally positioned within a subterranean well bore and usually made up of individual lengths of pipe which are secured together by, for example, screw threads.

Figure 18:
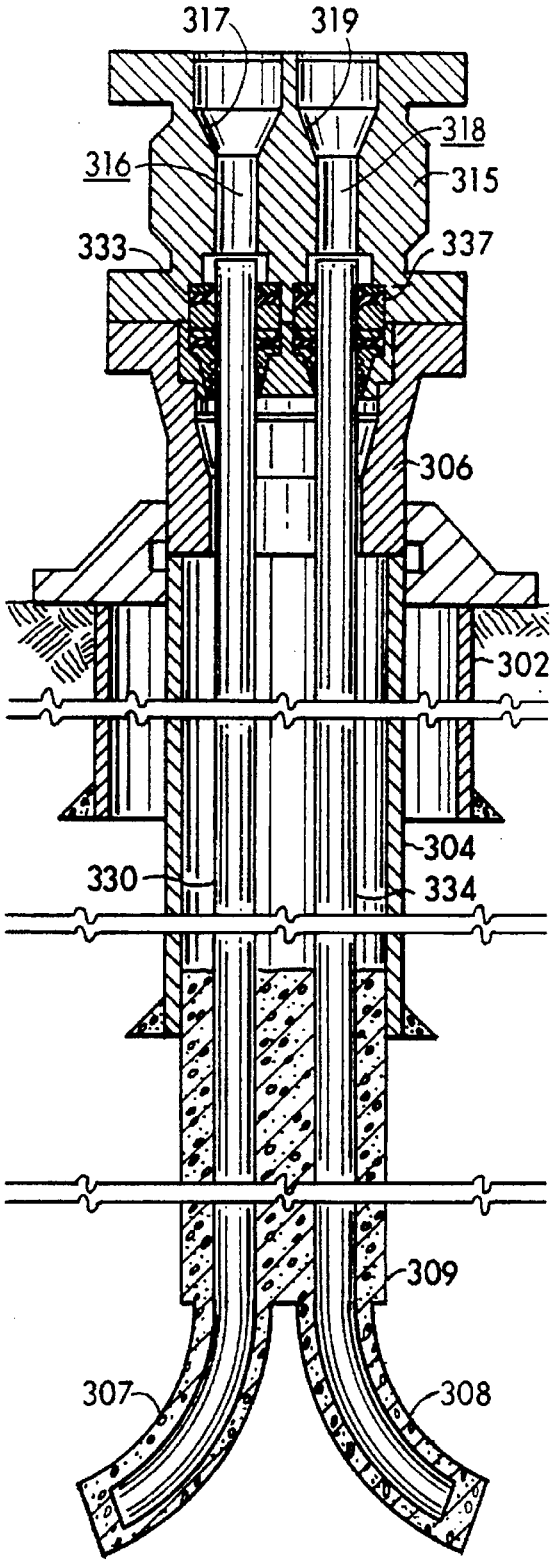
FIG. 18 is a sectional view of the surface template utilized in one embodiment of the present invention depicting sections of the wellhead secured together during construction of a well head assembly.

Once tubulars 330, 334 are secured to insert 320, a dual bore wellhead 315 (FIG. 18) is secured to wellhead 306 by any suitable means, such as by bolts (not illustrated), and has two bores 316, 318 therethrough which are substantially aligned with tubulars 330, 334. The diameter of each of bore 316, 318 is restricted along the length thereof thereby defining annular shoulders 317, 319, respectively. As assembled, packoff seal rings 333 and 337 function to provide a fluid tight seal between tubulars 330, 334 and dual bore wellhead 315. As thus positioned within well bores 309, 308 and possibly 307, tubulars 330 and 334 are cemented in a conventional manner, preferably by transporting a cement slurry via only one of the tubulars. It is preferred that the cement deposited in well bores 307, 308, and 309 extend into casing 304. Tubulars 330 and/or 334 can be placed directly in fluid communication with a subterranean formation(s) by any suitable means, for example a perforating gun, and fluids can be produced to the surface via tubulars 330 and/or 334. When well bore 307 is not drilled, tubular 330 may be cemented in well bore 309 as illustrated and placed in fluid communication with a subterranean formation(s) by any suitable means, such as, a perforating gun which is constructed and operated to fire in a radial pattern which does not penetrate or interfere with tubular 334.

Figure 19:
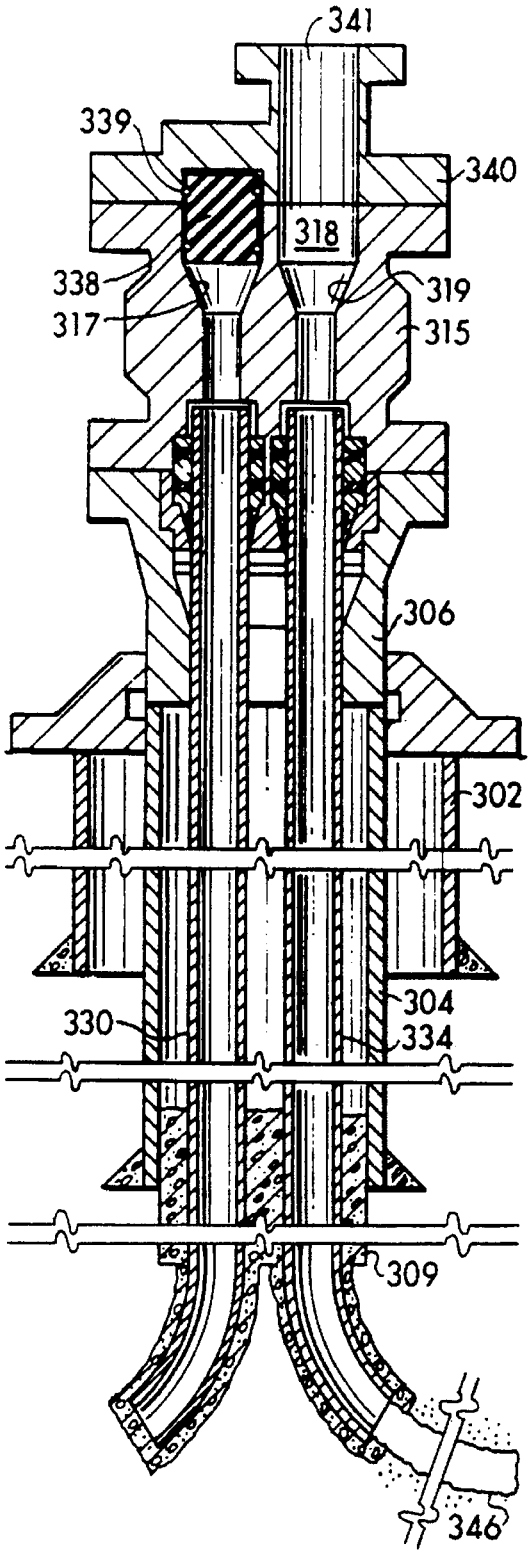
FIG. 19 is a sectional view of the surface template utilized in one embodiment of the present invention including a drilling flange utilized for drilling a first subterranean well bore through one bore of a dual bore wellhead and associated tubular of the template.
Figure 20:
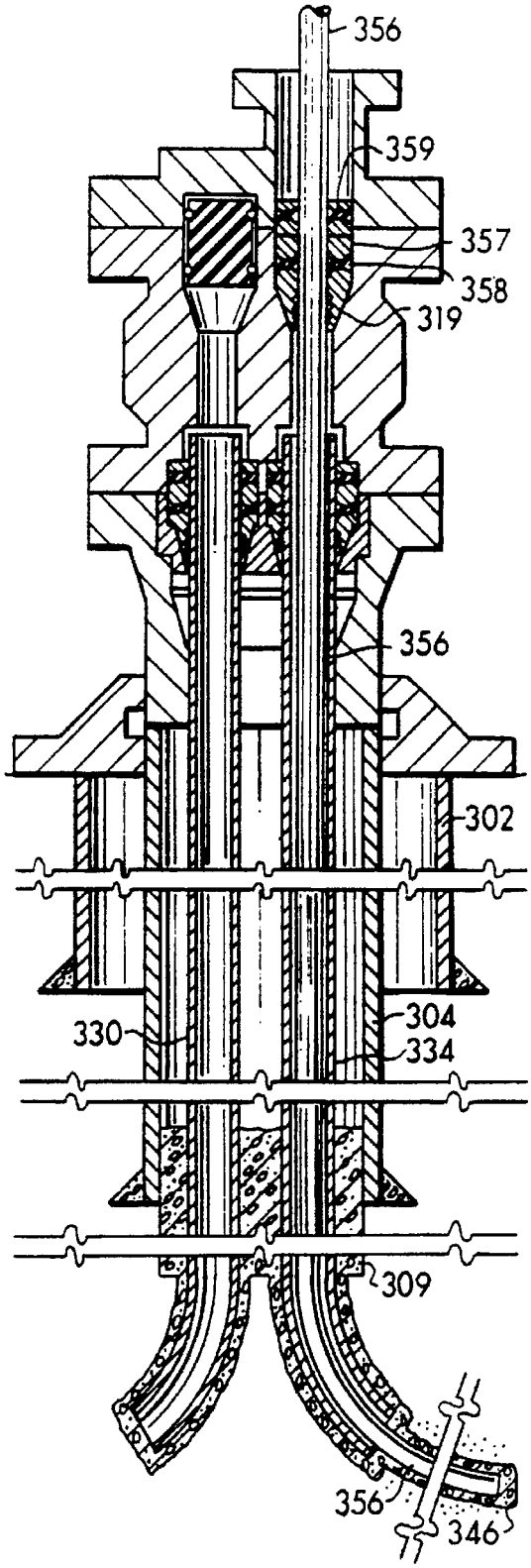
FIG. 20 is a partially sectioned view of the surface template illustrating production casing positioned within a first subterranean well bore drilled utilizing the surface template in accordance with one embodiment the present invention.

Alternatively, a plug 338 having seals 339, for example elastomeric O-rings, is positioned within the upper end of one of bores 316 or 318 through dual bore wellhead 315 (bore 316 as illustrated in FIG. 19) and a drilling flange 340 is secured to dual bore wellhead 315 by any suitable means, such as by bolts (not illustrated). Flange 340 has a bore 341 therethrough which is substantially aligned with bore 318 and tubular 334 so as to permit passage of a drilling string therethrough. Further, flange 340 is sized to be coupled to a conventional blow out preventer for safety during drilling as will be evident to a skilled artisan. As thus assembled, drilling flange 340, wellhead 306, dual bore wellhead 315 and tubulars 330, 334 provide an assembly through which two wells can be separately drilled and completed from the surface in a manner as hereinafter described so as to eliminate the need for downhole tools having moveable parts and the problems associated therewith. This assembly can be used during drilling of wells from onshore drilling rigs and/or offshore drilling platforms.

A drilling string having a drill bit secured to one end thereof is passed through bores 341 and 318 and tubular 334 to drill out any hardened cement present therein. The drilling string is advanced from the bottom of tubular 334 and a generally vertical or a deviated well bore 346 is drilled therefrom in a conventional manner so as to penetrate a subterranean formation or zone (FIG. 19). Once the well bore is drilled from tubular 334 and logged, if desired, production casing 356 (FIG. 19) is lowered from the surface until a portion thereof is positioned within well bore 346. The production casing 356 is first cemented within well bore 346 in a conventional manner with cement preferably extending up to the bottom of tubular 334. Prior to the cement setting, production casing 356 is secured within bore 318 of dual bore wellhead 315 by means of conventional casing slips 357 which are expanded into engagement with bore 318 of dual bore wellhead 315 upon contacting annular shoulder 319. Casing slips 357 are provided with a seal 358 to provide a fluid tight seal between bore 318 of dual bore wellhead 315 and production casing 356. The upper end of production casing 356 is also provided with conventional packoff seal rings 359.

Figure 21:
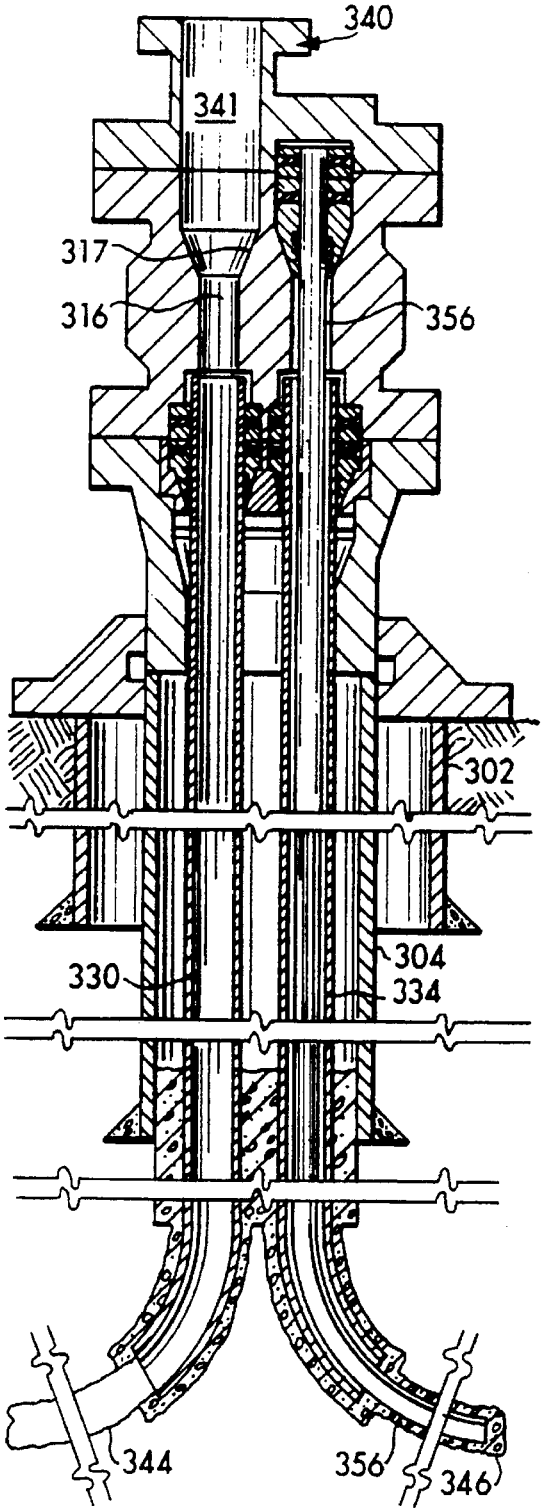
FIG. 21 is a partially sectioned view of the surface template including a drilling flange utilized for drilling a second subterranean well bore through another bore of the dual bore wellhead and associated tubular of the surface template in accordance with one embodiment of the present invention.
Figure 22:
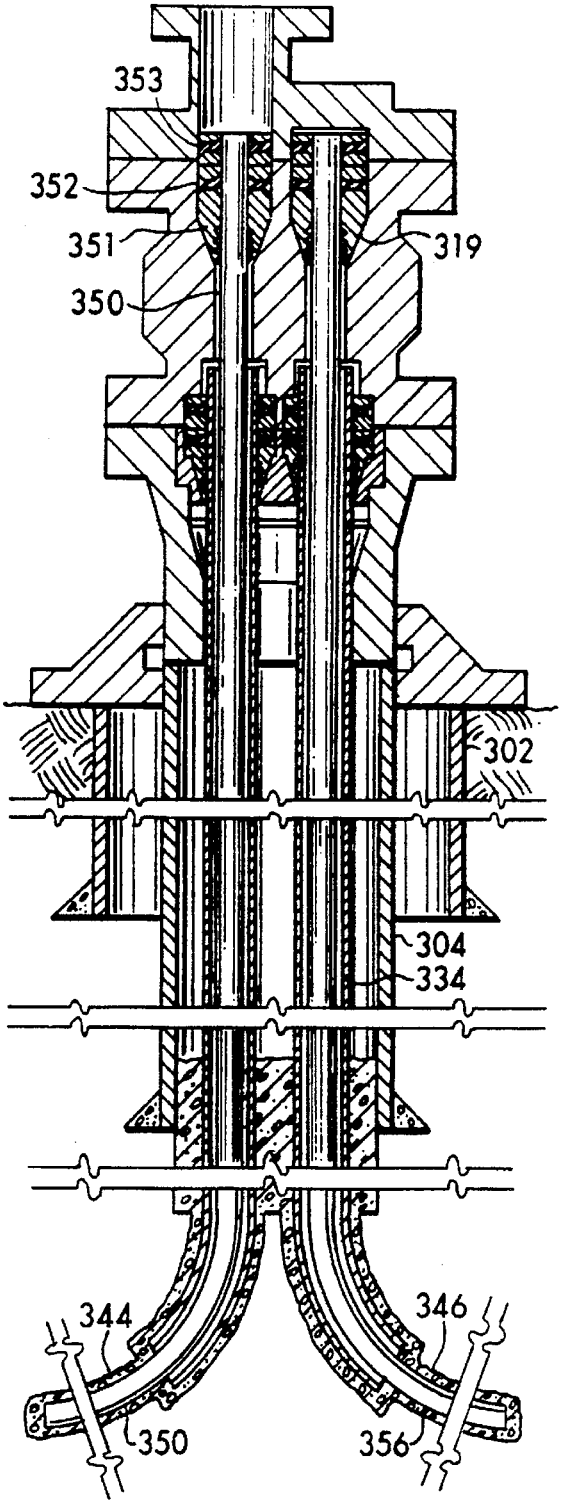
FIG. 22 is a partially sectioned view of the surface template illustrating production casing positioned within a second subterranean well bore drilled utilizing the surface template in accordance with one embodiment of the present invention.

Once production casing 356 is thus secured within bore 318 of dual bore wellhead 315 and cemented within well bore 346, drilling flange 340 is removed from dual bore wellhead 315 and the portion of production casing 356 extending beyond packoff seal rings 359 is severed or cut by conventional tools and plug 338 is removed from the upper end of bore 316. In the embodiment where well bore 307 is to be drilled, drilling flange 340 is again secured to dual bore wellhead 315 by any suitable means, such as by bolts (not illustrated), so that bore 341 through flange 340 is substantially aligned with bore 316 and tubular 330 so as to permit passage of a drilling string therethrough (FIG. 21 ). A conventional blow out preventer is again secured to drilling flange 340 to ensure safety during drilling. A drilling string having a drill bit secured to one end thereof is passed through bores 341 and 316 and tubular 330 to drill out any hardened cement present therein. The drilling string is advanced from the bottom of tubular 330 and a vertical or a deviated well bore 344 is drilled therefrom in a conventional manner so as to penetrate a subterranean formation. Once this well bore is drilled from tubular 330 and logged, if desired, production casing 350 is lowered from the surface until a portion thereof is positioned within well bore 344 as illustrated in FIG. 22. The production casing 350 is first cemented within well bore 344 in a conventional manner with cement preferably extending up to the bottom of tubular 330. Prior to the cement setting, production casing 350 is secured within bore 316 of dual bore wellhead 315 by means of conventional casing slips 351 which are expanded into engagement with bore 316 upon contacting annular shoulder 317. Casing slips 351 are provided with seals 352 to provide a fluid tight seal between bore 316 of dual bore wellhead 315 and production casing 350. The upper end of production casing 350 is also provided with conventional packoff seal rings 353. Any other conventional means, such as mandrel hangers, can be utilized in lieu of casing slips 351, 357 to secure production casing 350, 356, respectively, to dual bore wellhead 315. Once production casing 350 is thus secured within bore 316 of dual bore wellhead 315 and cemented within well bore 344, drilling flange 340 is removed from dual bore wellhead 315 and the portion of production casing 350 extending beyond packoff seal rings 353 is severed or cut by conventional tools (FIG. 23).

Figure 23:
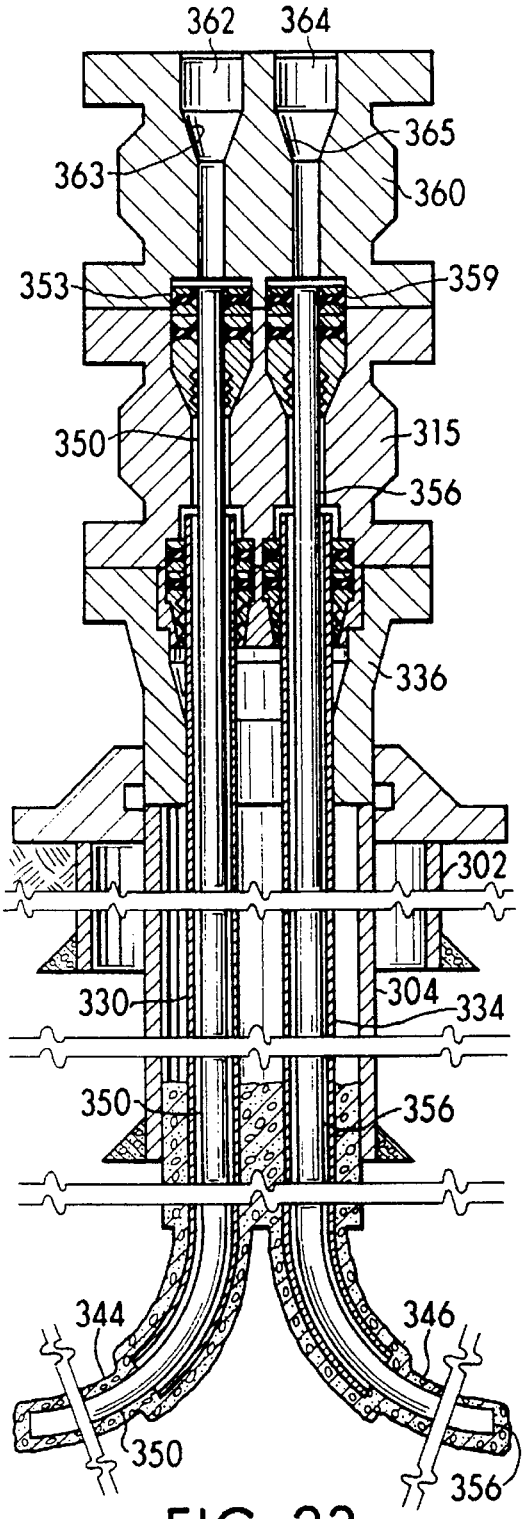
FIG. 23 is a partially sectioned view of the surface template including a dual bore tubing spool.
Figure 24:
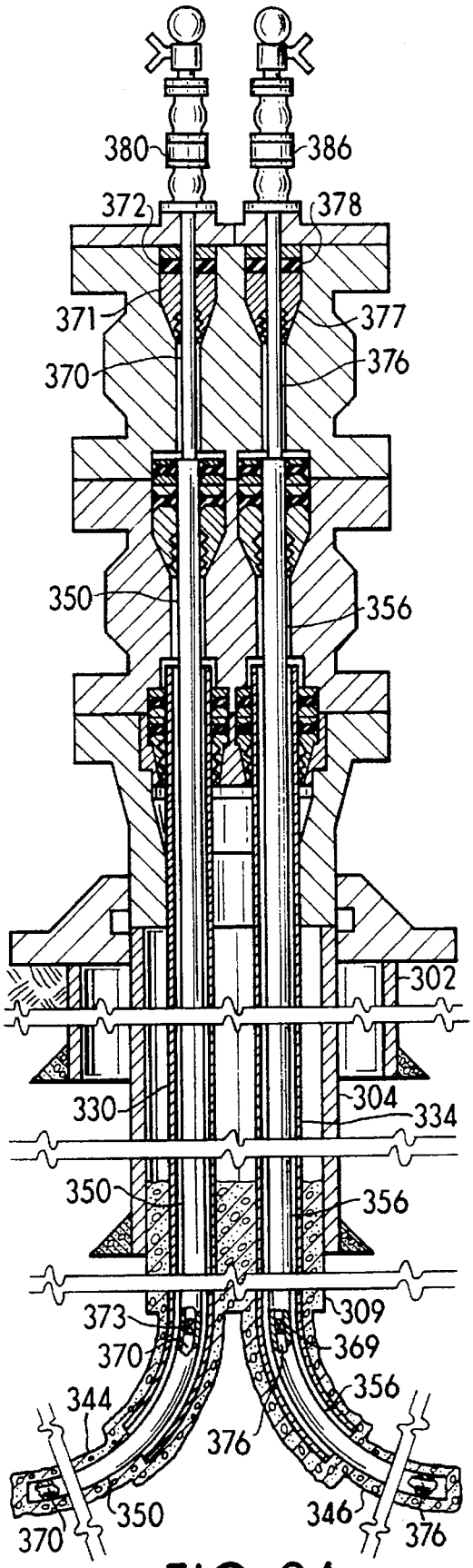
FIG. 24 is a partially sectioned view of the surface template and associate well head having separate production tubing positioned within first and second subterranean well bores drilled utilizing the surface template in accordance with one embodiment of the present invention, each well bore having separate production trees at the surface.

As illustrated in FIG. 23, a dual bore tubing spool 360 is secured onto dual bore wellhead 315 by any suitable means, such as by bolts (not illustrated), so that bores 362 and 364 through spool 360 are substantially aligned with production casing 350 and 356, respectively. Each of bores 362, 364 has a restriction in diameter which defines tapered sections 363, 365. Packoff seal rings 353, 359 function to provide a fluid tight seal between production casing 350, 356, respectively, and tubing spool 360. Production casings 350 and 356 are then placed in fluid communication with the subterranean formation(s) which each penetrate by any suitable means, for example by perforations, such that fluids, preferably hydrocarbons, enter casings 350 and 356 for production to the surface. As illustrated in FIG. 24, smaller diameter production tubing 370, 376 are positioned within production casing 350, 356, respectively, and are supported by means of conventional tubing hangers 371, 377 which am hung off into tubing spool 360 upon the tubing hangers contacting annular shoulders 363 and 365, respectively. Any other conventional means, such as mandrel hangers, can be utilized in lieu of tubing hangers 371, 377 (as illustrated in FIG. 24) to secure production tubing 370, 376, respectively, to tubing spool 360. The upper end of production tubing 370, 376 are also provided with conventional packoffs 372 and 378 to provide a fluid tight seal between tubing spool 360 and production tubing 370 and 76. Separate production trees 80 and 86 are installed so as to be in fluid communication with production tubing 370 and 376, respectively.

Figure 25:
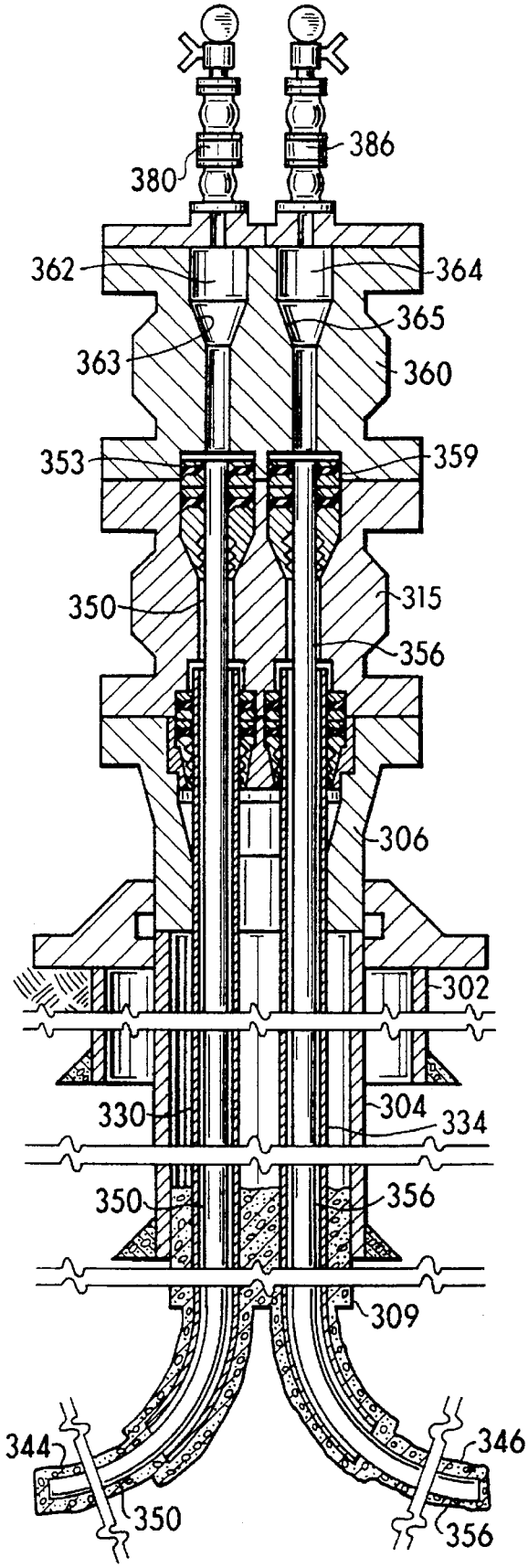
FIG. 25 is a partially sectioned view of the surface template which is partially illustrated in FIG. 23, wherein the first and second subterranean well bores drilled utilizing the surface template in accordance with one embodiment of the present invention have separate production trees at the surface so as to permit production of subterranean fluid through production casing positioned within each well bore.

Alternatively, fluids from subterranean formation(s) penetrated by production casing 350 and 356 can be produced to the surface of the earth directly through the production casing without the use of production tubing depending upon the particular application as will be evident to the skilled artisan. In this embodiment, separate production trees 380 and 386 are installed onto tubing spool 360 so as to be in fluid communication with production casing 350 and 356, respectively, as illustrated in FIG. 25.

As thus drilled and completed in accordance with this embodiment of the present invention, two subterranean wells 344, 346 are drilled into the same or different subterranean formations, horizons or zones, to identical or different total depths, and are each deviated. By drilling well bores 307 and/or 308 and inserting tubulars 330 and 334, respectively, therein, the degree of separation between deviated wells 344 and 346 is significantly increased thereby permitting greater separation and increased production from a given subterranean formation. Wells 344 and 346 are separately completed to the surface through a single or common well bore so that fluid can be simultaneously produced from and/or injected into the subterranean formation(s) via both wells. Or a remedial operation including, but not limited to workovers, recompletions, and side tracking, can be performed in one well while hydrocarbons are simultaneously produced from or fluid injected into a subterranean formation via the other well. In addition, fluid can be injected into a subterranean formation via one well as hydrocarbons are being produced from the same or a different subterranean formation via the other well.

Figure 26:
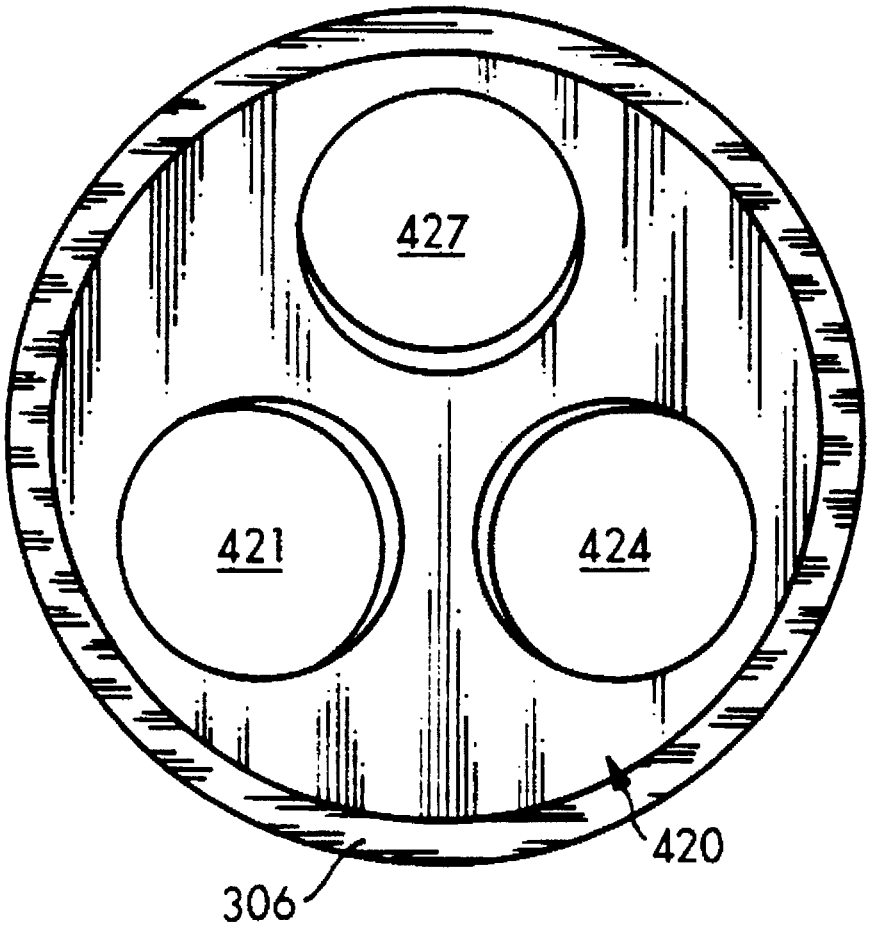
FIG. 26 is a top view of an insert of the surface template which has three bores therethrough as positioned in and supported by the wellhead assembly.
Figure 27:
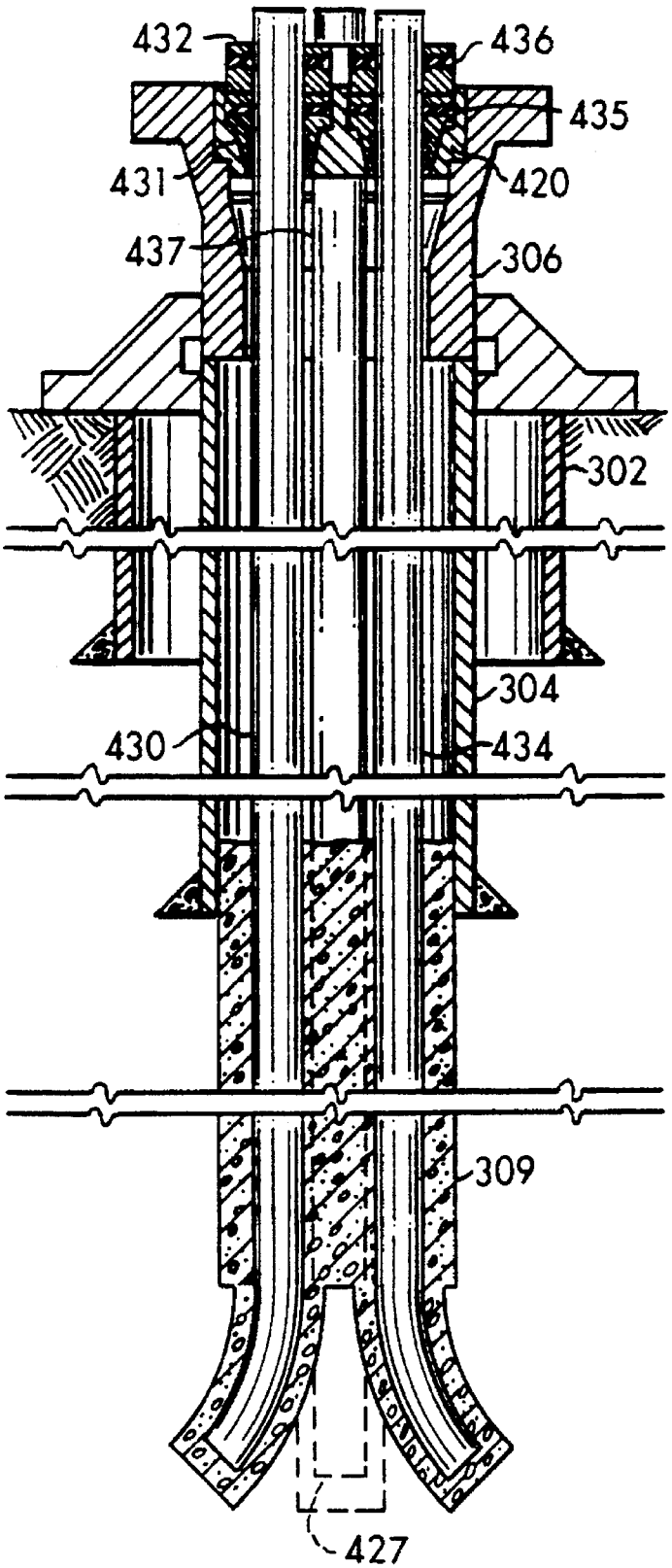
FIG. 27 is a sectional view of a surface template utilized in accordance with one embodiment of the present invention illustrating three tubulars depending from the wellhead.

Although the insert of the surface template utilized in accordance with the present invention has been illustrated and described as having two bores through which two separate lengths of surface casing are positioned, it will be evident to a skilled artisan that an insert can be provided with more than two bores and that more than two strings of surface casing can be positioned through such bores depending upon the diameter of the surface well bore and the surface casings inserted therein. For example, an insert 420 is provided with three bores 421, 424, and 427 (FIG. 26) therethrough and is positioned within and supported by the wellhead 330 in a manner as described above with respect to insert 320. Tubulars 430, 434, and 437 are positioned through bores 421, 424, and 427, respectively, (FIG. 27) and secured therein in a manner as described above with respect to tubulars 330 and 334. As constructed in this manner, the surface template will permit three subterranean wells to be separately drilled and completed in accordance with the present invention.

The following example demonstrates the practice and utility of the present invention, but is not to be construed as limiting the scope thereof.

EXAMPLE

A drilling rig is skidded over a slot on a conventional monopod offshore drilling platform and a 36 inch diameter bore is drilled from mudline to 400 feet. A 30 inch diameter, ½ inch thick casing is positioned within the bore and is conventionally cemented therein. A drill string with a 17½ inch drill bit is inserted within the 30 inch casing and a 17½ inch diameter bore is drilled from 450 feet to a 2500 foot depth and is under reamed to 28 inch diameter. A 24 inch diameter, ⅝ inch thick casing string is run to 2500 feet and cemented. A 12¼ inch diameter bore is drilled from 2500 feet to 12,000 feet and is under reamed to a 24 inch diameter from 2500 feet to 4500 feet. A 20 inch diameter casing having one embodiment of the template of the present invention secured to the lowermost joint thereof is positioned within the 24 inch well bore and is secured to the 24 inch casing by means of well head equipment and a conventional mandrel hanger. The template has one set of 9⅝ inch diameter tubular(s) which are positioned within the 24 inch diameter bore at the setting depth of the template, i.e. approximately 4500 feet. The other set of 9⅝ inch diameter tubulars of the template extend into the 12¼ inch diameter bore to a depth of approximately 12,000 feet. The seal section of the lower end of a 9⅝ inch diameter riser is inserted into the bore through the template which is equipped with a one way valve and cement is circulated through the tubulars of the template extending to approximately 12,000 feet to cement the template within both bores and the 20 inch casing within the 24 inch bore. Any cement remaining within the 9⅝ inch tubular is drilled out and a 8½ inch diameter directional bore is then drilled to the objective depth of 15,000 feet by a drill string which is equipped with a conventional mud motor and which is passed through the riser and the tubulars of the template which are positioned within the 12,000 foot bore. Thereafter, a 7 inch casing which is equipped with a liner hanger is positioned within the 8½ inch directional bore and secured therein by engaging the liner hanger with the profile contained within the template bore. The 7 inch casing is rotated while cement is pumped through the drill string and liner. The riser is then withdrawn from the first bore in the template of the present invention and is inserted into the other bore therethrough, i.e. the bore through the 9⅝ inch diameter tubular(s) which are positioned at approximately 4500 feet. A second 8½ inch diameter directional bore is drilled to 9,000 feet and completed within a second subterranean objective via the second bore. Thereafter, a 7 inch casing which is equipped with a liner hanger is positioned within the 8½ inch directional bore and secured therein by engaging the liner hanger with the profile contained within the template bore in a manner as described above. The riser is then removed from the well and separate strings of 7 inch casing having a seal assembly secured to the lower end thereof are separately and sequentially inserted into separate template bores and tied into the tops of the 7 inch liner hangers and secured to conventional dual completion surface equipment.

Figure 28A:
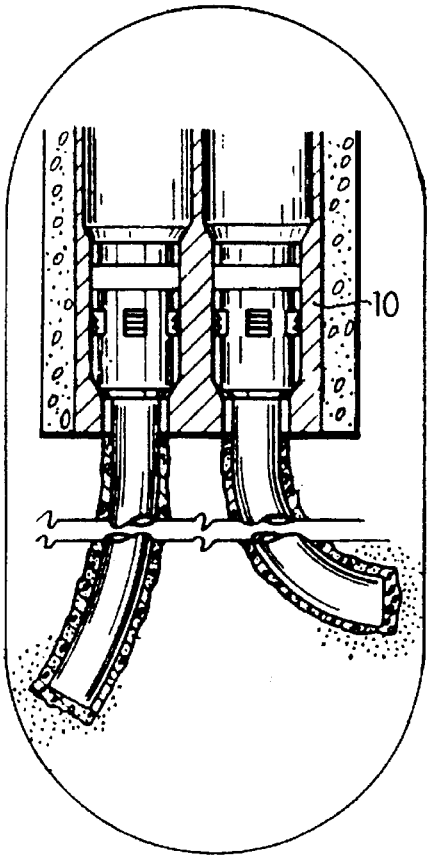
FIG. 28 is a sectional view of the subterranean well system developed by utilizing the embodiment of the present invention wherein a subsurface or downhole splitter is employed in conjunction with a surface splitter to drill and complete at least two subterranean well bores from at least one tubular of a surface template.
Figure 28:
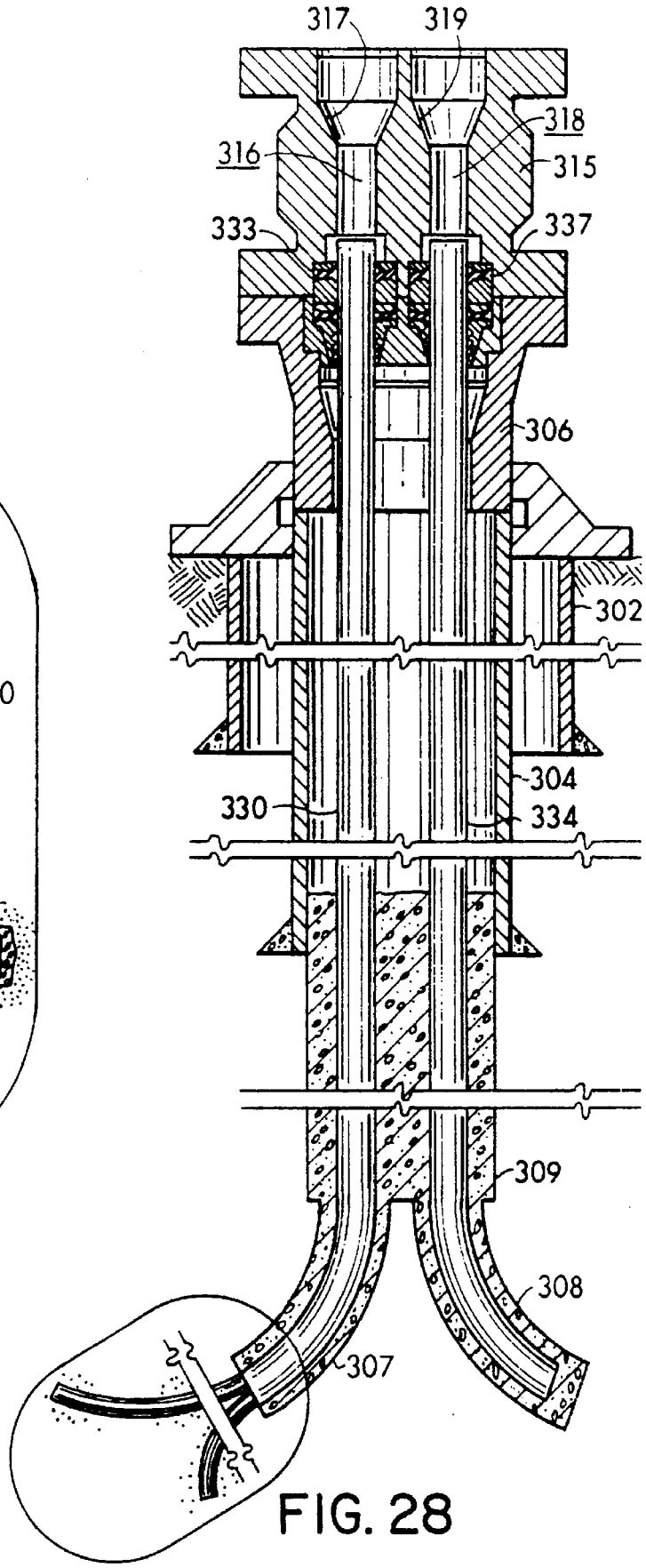

Although described throughout this description as being separately utilized in the process of the present invention, downhole or subsurface template 10 or 100 can be secured to at least one tubular 330, 334 of surface template 300 to drill two or more separate subterranean wells from each of well bores 307 and 308, respectively. Wells drilled in this manner can be separately completed to the surface in a manner as described above with respect to wells 60 and 70 (FIG. 14), or alternatively, the wells can be separately completed to the downhole or subsurface template 10 or 100 by means of liners 64, 74 and the associated liner hangers and packers, and production therefrom commingled to the surface via one tubular 330, 334 of surface template 300 (FIG. 28). When a downhole or subsurface template 10 or 100 is utilized with a tubular of a surface template, bores 20, 30 or 120, 130 of the downhole template may be of the same or of differing lengths, and when these bores are of differing lengths, bores 20, 30 or 120, 130 may be positioned only within well bore 309. It is within the scope of the present invention that three or more well bores can be drilled from a common well bore utilizing separate tubulars of a surface template, in a manner as previously described, and that three or more wells can be drilled and separately completed from each of these well bores by means of a downhole or subsurface template which is secured to each of such tubulars of the surface template.

While the foregoing preferred embodiments of the invention have been described and shown, it is understood that the alternatives and modifications, such as those suggested and others, may be made thereto and fall within the scope of the invention.

I claim:

1. A subterranean well system comprising:

a first subterranean well bore extending to the surface of the earth;

a second subterranean well bore drilled from the first well bore; and a first tubular of a drilling and completion template which is positioned within said first well bore; and a second tubular of said template which is positioned within both said first and said second well bores.

2. The system of claim 1 wherein said first tubular is in fluid communication with a first formation to convey fluids from said first formation to the surface.

3. The system of claim 1 further comprising:

a first length of production casing extending from the surface of the earth into said first tubular and for conveying fluid produced from a first formation through said first tubular to the surface.

4. The system of claim 3 further comprising:

production tubing positioned within said first tubular and said first length of production casing.

5. The system of claim 1 wherein said second tubular is in fluid communication with a second subterranean formation to convey fluids from said second formation to the surface.

6. The system of claim 5 further comprising:

a second length of production casing extending from the surface of the earth into said second tubular and for conveying fluid produced from said second subterranean formation through said second tubular to the surface.

7. The system of claim 6 further comprising:

production tubing positioned within said second tubular and said second length of production casing.

8. The system of claim 1 further comprising:

a third subterranean well bore drilled from said second well bore.

9. The system of claim 8 wherein said first well bore penetrates a first subterranean formation and said third well bore penetrates a second subterranean formation.

10. The system of claim 9 further comprising:

a first length of production casing extending from said second tubular and into said third well bore so as to establish fluid communication with said second formation for conveying fluid produced from said second formation to the surface.

11. The system of claim 10 further comprising:

a second length of production casing extending from the surface of the earth into said third length of production casing for conveying fluid produced from said second formation to the surface.

12. The system of claim 11 further comprising:

production tubing positioned within said first and said second lengths of production casing.

13. The system of claim 1 further comprising:

a fourth subterranean well bore drilled from said first well bore.

14. The system of claim 13 further wherein said fourth well bore penetrates a first subterranean formation and said second well bore penetrates a second subterranean formation.

15. The system of claim 14 further comprising:

a first length of production casing extending from said first tubular and into said fourth well bore so as to establish fluid communication with said first formation for conveying fluid produced from said first formation to the surface.

16. The system of claim 15 further comprising:

a second length of production casing extending from the surface of the earth into said fifth length of production casing for conveying fluid produced from said first formation to the surface.

17. The system of claim 16 further comprising:

production tubing positioned within said first and said second lengths of production casing.

18. The system of claim 1 wherein said first well bore is generally vertical.

19. The system of claim 1 wherein said first well bore is deviated.

20. The system of claim 9 wherein said second and third well bores are deviated.

21. The system of claim 14 wherein said fourth well bore is deviated.

22. The system of claim 1 wherein said first well bore penetrates a first subterranean formation and said second well bore penetrates a second subterranean formation, said first and said second subterranean formations being the same formation.

23. The system of claim 1 wherein said first well bore penetrates a first subterranean formation and said second well bore penetrates a second subterranean formation, said first subterranean formation being distinct from said second subterranean formation.

24. The system of claim 1 wherein said template is secured to said first well bore at the surface of the earth.

25. The system of claim 1 wherein said template is secured within said first well bore at a subterranean location.

26. A subterranean well system comprising:

a first subterranean well bore extending to the surface of the earth;

a second subterranean well bore drilled from the first well bore;

a third subterranean well bore drilled from the first well bore;

a first tubular of a drilling and completion template which is positioned within both said first and said second well bores; and a second tubular of said template which is positioned within both said first and said third well bores.

27. The system of claim 26 wherein said first tubular is in fluid communication with a first formation to convey fluid from said first formation to the surface.

28. The system of claim 27 further comprising:

production tubing positioned within said first tubular for conveying fluid from said first formation to the surface.

29. The system of claim 26 further comprising:

a fourth subterranean well bore drilled from said second well bore so as to penetrate a first subterranean formation.

30. The system of claim 29 further comprising:

a first length of production casing extending from the surface of the earth through said first tubular and into said fourth well bore for conveying fluid produced from said first formation to the surface.

31. The system of claim 26 further comprising:

a fourth subterranean well bore drilled from said second well bore so as to penetrate a first subterranean formation; and a first length of production casing extending from said first tubular and into said fourth well bore for conveying fluid produced from said first formation to said first well bore.

32. The system of claim 30 further comprising:

production tubing positioned within said first length of production casing.

33. The system of claim 27 wherein said second tubular is in fluid communication with a second subterranean formation.

34. The system of claim 27 further comprising:

production tubing positioned within said second tubular for conveying fluid from a second formation to the surface.

35. The system of claim 29 further comprising:

a fifth subterranean well bore drilled from said third well bore so as to penetrate a second subterranean formation.

36. The system of claim 35 further comprising:

a second length of production casing extending from the surface of the earth through said second tubular and into said fifth well bore for conveying fluid produced from said second formation to the surface.

37. The system of claim 29 further comprising:

a fifth subterranean well bore drilled from said third well bore so as to penetrate a second subterranean formation; and a second length of production casing extending from said second tubular and into said fifth well bore for conveying fluid produced from said second formation to said first well bore.

38. The system of claim 36 further comprising:

production tubing positioned within said second length of production casing.

39. The system of claim 26 wherein said template is secured to said first well bore at the surface of the earth.

40. A subterranean well system comprising:

a first subterranean well bore extending to the surface of the earth;

a second subterranean well bore drilled from the first well bore;

a third subterranean well bore drilled from the first well bore;

a fourth subterranean well bore drilled from said second well bore;

a fifth subterranean well bore drilled from said third well bore;

a first tubular of a drilling and completion template which is positioned within both said first and said second well bores; and a second tubular of said template which is positioned within both said first and said third well bores.

41. The system of claim 40 wherein said third well bore penetrates a first subterranean formation and said fifth well bore penetrates a second subterranean formation.

42. The system of claim 41 further comprising:

a first length of production casing extending from said first tubular and into said fourth well bore for conveying fluid produced from said first formation to the surface; and a second length of production casing extending from said second tubular and into said fifth well bore for conveying fluid produced from said second formation to the surface.

43. The system of claim 41 further comprising:

a first length of production casing extending from the surface of the earth through said first tubular and into said fourth well bore for conveying fluid produced from said first formation to the surface; and a second length of production casing extending from the surface of the earth through said second tubular and into said fifth well bore for conveying fluid produced from said second formation to the surface.

44. The system of claim 43 further comprising:

first production tubing positioned within said first length of production casing for conveying fluid produced from said first formation to the surface; and second production tubing positioned within said second length of production casing for conveying fluid produced from said second formation to the surface.

45. The system of claim 40 wherein said first well bore is generally vertical.

46. The system of claim 40 wherein said first well bore is deviated.

47. The system of claim 40 wherein said second and third well bores are deviated.

48. The system of claim 41 wherein said first and said second subterranean formations are the same formation.

49. The system of claim 40 wherein said template is secured to said first well bore at the surface of the earth.

50. The system of claim 40 wherein said template is secured within said first well bore at a subterranean location.

51. A subterranean well system comprising:

a first subterranean well bore extending to the surface of the earth;

a first tubular of a first template which is positioned within said first well bore and a second tubular of said first template which is positioned within said first well bore; and at least two wells drilled by means of a second template which is secured to said second tubular.

52. The system of claim 51 wherein said at least two wells are drilled from said first well bore.

53. The system of claim 51 further comprising:

a second subterranean well bore drilled from the first well bore, said second tubular being positioned within both said first and said second well bores and said at least two wells being drilled from said second well bore.

54. The system of claim 53 further comprising:

a first length of production casing extending from said second template into one of said two wells which are drilled from said second well bore and in fluid communication with a first formation penetrated by said one of said two wells for producing fluids from said first formation to the surface of the earth via said first tubular.

55. The system of claim 54 further comprising:

a second length of production casing extending from said second template to the surface for producing fluids from said first formation to the surface of the earth via said first and said second lengths of production casing.

56. The system of claim 55 further comprising:

production tubing positioned within said first and second lengths of production casing.

57. The system of claim 54 further comprising:

a third length of production casing extending from said second template into another of said two wells which are drilled from said second well bore and in fluid communication with a second formation for producing fluids from said second formation to the surface of the earth via said second tubular.

58. The system of claim 57 wherein said first and said second subterranean formations are the same formation.

59. The system of claim 57 wherein said first subterranean formation is distinct from said second subterranean formation.

60. The system of claim 55 further comprising:

a third length of production casing extending from said second template into another of said two wells which am drilled from said second well bore and in fluid communication with a second formation for producing fluids from said second formation to the surface of the earth via said first tubular; and a fourth length of production casing extending from said second template to the surface for producing fluids from said second formation to the surface of the earth via said third and said fourth lengths of production casing.

61. The system of claim 60 wherein said first and said second subterranean formations are the same formation.

62. The system of claim 60 further comprising:

production tubing positioned within said third and fourth lengths of production casing.

63. The system of claim 51 further comprising:

at least two wells drilled from said first well bore into a subterranean formation by means of a third template which is secured to said first tubular.

64. A process for drilling and completing subterranean wells via a first well bore which extends from the surface of the earth to a depth, said process comprising:

drilling a second subterranean well bore from the first well bore;

positioning a first tubular of a drilling and completion template within said first well bore; and positioning a second tubular of said template within both said first and said second well bores.

65. The process of claim 64 further wherein said first well bore penetrates a first subterranean formation and said second well bore penetrates a second subterranean formation.

66. The process of claim 65 further comprising:

placing said first tubular in fluid communication with said first formation; and producing fluids from said first formation to the surface.

67. The process of claim 66 further comprising:

positioning a first length of production casing from the surface into said first tubular; and producing fluid from said first formation to the surface.

68. The process of claim 67 further comprising:

positioning production tubing within said first tubular and said first length of production casing; and sealing the annulus defined between said first length of production casing and said production tubing.

69. The process of claim 64 further comprising:

placing said second tubular in fluid communication with a second subterranean formation; and producing fluid from said second formation to the surface.

70. The process of claim 69 further comprising:

positioning a second length of production casing from the surface of the earth into said second tubular; and producing fluid from said second formation to the surface.

71. The process of claim 70 further comprising:

positioning production tubing within said second tubular and said second length of production casing; and sealing the annulus defined between said second length of production casing and said production tubing.

72. The process of claim 64 further comprising:

drilling a third subterranean well bore from said second well bore.

73. The process of claim 72 wherein said first well bore penetrates a first subterranean formation and said third well bore penetrates a second subterranean formation.

74. The process of claim 73 further comprising:

positioning a third length of production casing from the surface of the earth through said second tubular and into said third well bore;

placing said third length of production casing in fluid communication with said second formation; and producing fluid from said second formation to the surface.

75. The process of claim 74 further comprising:

positioning a fourth length of production casing from the surface of the earth into said third length of production casing for conveying fluid produced from said second formation to the surface.

76. The process of claim 75 further comprising:

positioning production tubing within said third and said fourth lengths of production casing, sealing the annulus defined between said third length of production casing and said production tubing.

77. The process of claim 64 further comprising:

drilling a fourth subterranean well bore from said first well bore.

78. The process of claim 77 further wherein said fourth well bore penetrates a first subterranean formation and said second well bore penetrates a second subterranean formation.

79. The process of claim 78 further comprising:

positioning a fifth length of production casing from the surface of the earth through said first tubular and into said fourth well bore;

placing said fifth length of production casing in fluid communication with said first formation; and producing fluid from said first formation to the surface.

80. The system of claim 79 further comprising:

positioning a sixth length of production casing from the surface of the earth into said fifth length of production casing for conveying fluid produced from said first formation to the surface.

81. The process of claim 80 further comprising:

positioning production tubing within said fifth and said sixth lengths of production casing; and sealing the annulus defined between said fifth length of production casing and said production tubing.

82. The process of claim 64 further comprising:

securing said template to said first well bore at the surface of the earth.

83. The process of claim 64 further comprising:

securing said template within said first well bore at a subterranean location.

84. A process for drilling and completing a subterranean well system from a first subterranean well bore extending to the surface of the earth comprising:

drilling a second subterranean well bore from the first well bore;

drilling a third subterranean well bore from the first well bore;

positioning a first tubular of a drilling and completion template within both said first and said second well bores; and positioning a second tubular of said template within both said first and said third well bores.

85. The process of claim 84 wherein said second well bore penetrates a first subterranean formation and said third well bore penetrates a second subterranean formation.

86. The process of claim 85 further comprising:

placing said first tubular in fluid communication with said first formation; and producing fluid from said first formation to the surface.

87. The process of claim 86 further comprising:

positioning production tubing within said first tubular, said fluid being produced from said first formation to the surface via said production tubing.

88. The process of claim 87 further comprising:

drilling a fourth subterranean well bore from said second well bore so as to penetrate a first subterranean formation.

89. The process of claim 84 further comprising:

positioning a first length of production casing from the surface of the earth through the first tubular and into said fourth well bore; and producing fluid from said first formation to the surface.

90. The process of claim 89 further comprising:

positioning production tubing within said first length of production casing; and sealing the annulus defined between said first length of production casing and said production tubing.

91. The process of claim 88 further comprising:

positioning a first length of production casing from said first tubular and into said fourth well bore; and producing fluid from said first formation to the surface via said first length of production casing and said first well bore.

92. The process of claim 86 wherein said second tubular is in fluid communication with said second subterranean formation.

93. The process of claim 92 further comprising:

positioning production tubing within said second tubular; and producing fluid from said second formation to the surface via said production tubing.

94. The process of claim 88 further comprising:

drilling a fifth subterranean well bore from said third well bore so as to penetrate a second subterranean formation.

95. The process of claim 94 further comprising:

positioning a second length of production casing from the surface of the earth through said second tubular and into said fifth well bore; and producing fluid from said second formation to the surface via said second length of production casing.

96. The process of claim 95 further comprising:

positioning production tubing within said second length of production casing; and sealing the annulus defined between said first length of production casing and said production tubing.

97. The process of claim 94 further comprising:

positioning a second length of production casing from said second tubular into said fifth well bore; and producing fluid from said second formation to the surface of the earth via said second length of production casing and said first well bore.

98. The process of claim 88 further comprising:

securing said template to said first well bore at the surface of the earth.

99. A process for drilling and completing a subterranean well system from a first subterranean well bore extending to the surface of the earth, said process comprising:

positioning a first tubular of a first template within said first well bore;

positioning a second tubular of said first template within said first well bore; and drilling at least two wells through a second template which is secured to said second tubular.

100. The process of claim 99 wherein said at least two wells are drilled from said first well bore.

101. The process of claim 99 further comprising:

drilling a second subterranean well bore from the first well bore, said second tubular being positioned within both said first and said second well bores and said at least two wells being drilled from said second well bore.

102. The process of claim 101 wherein said second template is secured to said second tubular within said second well bore.

103. The process of claim 101 further comprising:

positioning a first length of production casing from said second template into one of said two wells which are drilled from said second well bore;

producing fluid from a first formation penetrated by said one of said two wells to the surface of the earth via said first length of production casing which is in fluid communication with said first formation and said second tubular.

104. The process of claim 103 further comprising:

positioning a second length of production casing from said second template to the surface for conveying fluid produced from said first formation to the surface of the earth via said first and said second lengths of production casing.

105. The process of claim 104 further comprising:

positioning production tubing within said first and second lengths of production casing; and sealing the annulus defined between said first length of production casing and said production tubing.

106. The process of claim 103 further comprising:

positioning a third length of production casing from said second template into another of said two wells which are drilled from said second well bore; and producing fluid from a second formation penetrated by said another of said two wells to the surface of the earth via said third length of production casing which is in fluid communication with said second formation and said second tubular.

107. The process of claim 104 further comprising:

positioning a third length of production casing from said second template into another of said two wells which are drilled from said second well bore, said third length of production casing being in fluid communication with said second formation; and positioning a fourth length of production casing from said second template to the surface; and producing fluid from said second formation to the surface of the earth via said third and said fourth lengths of production casing.

108. The process of claim 107 further comprising:

positioning production tubing within said third and fourth lengths of production casing; and sealing the annulus defined between said first length of production casing and said production tubing.

109. The process of claim 99 further comprising:

drilling at least two wells from said first well bore into a subterranean formation by means of a third template which is secured to said first tubular.

110. A subterranean well system comprising:

a first subterranean well bore extending to the surface of the earth, said first well bore being generally vertical;

a second subterranean well bore drilled from the first well bore; and a first tubular of a drilling and completion template which is positioned within said first well bore; and a second tubular of said template which is positioned within both said first and said second well bores.

111. A subterranean well system comprising:

a first subterranean well bore extending to the surface of the earth, said first well bore being deviated;

a second subterranean well bore drilled from the first well bore; and a first tubular of a drilling and completion template which is positioned within said first well bore; and a second tubular of said template which is positioned within both said first and said second well bores.

112. A subterranean well system comprising:

a first subterranean well bore extending to the surface of the earth;

a second subterranean well bore drilled from the first well bore;

a third subterranean well bore drilled from the first well bore;

a first tubular of a drilling and completion template which is positioned within both said first and said second well bores, said template being secured to said first well bore at the surface of the earth; and a second tubular of said template which is positioned within both said first and said third well bores.

* * * * *